US007161573B1

(12) United States Patent
Takatori et al.

(10) Patent No.: US 7,161,573 B1
(45) Date of Patent: Jan. 9, 2007

(54) LIQUID CRYSTAL DISPLAY UNIT AND METHOD FOR DRIVING THE SAME

(75) Inventors: Ken-ichi Takatori, Tokyo (JP); Ken Sumiyoshi, Tokyo (JP); Shin-ichi Uehara, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/256,346

(22) Filed: Feb. 24, 1999

(30) Foreign Application Priority Data

Feb. 24, 1998 (JP) ..... 10/041689
Mar. 16, 1998 (JP) ..... 10/065177

(51) Int. Cl.
*G09G 3/36* (2006.01)

(52) U.S. Cl. ..... 345/96

(58) Field of Classification Search ..... 358/236; 345/95, 96, 97, 89, 87, 55, 63, 88
See application file for complete search history.

(56) References Cited

U.S. PATENT DOCUMENTS 4,109,242 A * 8/1978 Channin ..... 345/94
4,694,348 A * 9/1987 Kamiya et al. ..... 358/236
4,800,382 A * 1/1989 Okada et al. ..... 340/784
4,803,480 A * 2/1989 Soneda et al. ..... 345/100
4,908,710 A * 3/1990 Wakai et al. ..... 348/793
5,058,994 A * 10/1991 Mihara et al. ..... 345/97
5,122,870 A * 6/1992 Takeda et al. ..... 348/751
5,233,338 A * 8/1993 Surguy ..... 345/88
5,365,284 A * 11/1994 Matsumoto et al. ..... 348/793
5,430,460 A * 7/1995 Takabatake et al. ..... 345/96
5,606,343 A * 2/1997 Tsuboyama et al. ..... 345/97
5,673,062 A * 9/1997 Katakura et al. ..... 345/95
5,682,177 A * 10/1997 Kuwata et al. ..... 345/100
5,790,092 A * 8/1998 Moriyama ..... 345/96
5,796,380 A * 8/1998 Kurematsu ..... 345/96
5,850,216 A * 12/1998 Kwon ..... 345/204
5,872,563 A * 2/1999 Asada ..... 345/212
5,923,311 A * 7/1999 Edwards ..... 345/92
6,008,787 A * 12/1999 Kondoh ..... 345/97
6,028,963 A * 2/2000 Kajiwara ..... 382/239
6,075,506 A * 6/2000 Bonnett et al. ..... 345/89
6,172,662 B1 * 1/2001 Ito et al. ..... 345/94
6,188,379 B1 * 2/2001 Kaneko ..... 345/102
6,195,137 B1 * 2/2001 Inaba et al. ..... 349/37
6,208,323 B1 * 3/2001 Ito et al. ..... 345/100
6,295,043 B1 * 9/2001 Hashimoto et al. ..... 345/96

FOREIGN PATENT DOCUMENTS

JP 401059333 * 3/1989 ..... 345/94
JP 3-35219 2/1991
JP 3-251818 11/1991
JP 4-186217 7/1992
JP 5-127628 5/1993
JP 5-265403 10/1993
JP 405303076 * 11/1993 ..... 349/143

(Continued)

*Primary Examiner*—Richard Hjerpe
*Assistant Examiner*—Alecia D. Nelson
(74) *Attorney, Agent, or Firm*—Sughrue Mion, PLLC

(57) ABSTRACT

In a method for driving a liquid crystal display apparatus in which in each field, scan lines are successively scanned in order to display an image, the scanning sequence or the polarity of a signal voltage is reversed between a first field and a second field. A liquid crystal display apparatus driven by the method is also disclosed. It is possible to provide a high contrast, high brightness liquid crystal display apparatus which is not affected by electrical asymmetry.

13 Claims, 32 Drawing Sheets

FOREIGN PATENT DOCUMENTS

| | | | |
|---|---|---|---|
| JP | 6-222330 | | 8/1994 |
| JP | 6-222360 | * | 8/1994 |
| JP | 6-230751 | | 8/1994 |
| JP | 408068984 | * | 8/1994 |
| JP | H6-222360 | | 8/1994 |
| JP | 7-140933 | | 6/1995 |
| JP | H7-199149 | | 8/1995 |
| JP | 7-248485 | | 9/1995 |
| JP | 08234161 | * | 6/1996 |
| JP | 8-234161 | * | 9/1996 |
| JP | 08-234161 | | 9/1996 |
| JP | H8-234161 | | 9/1996 |
| JP | 406026583 | * | 1/1997 |
| JP | H9-90909 | | 4/1997 |
| JP | H9-304794 | | 11/1997 |
| JP | 9-319342 | | 12/1997 |

* cited by examiner (a) DATA VOLTAGE (b) TRANSMITTANCE (a) DATA VOLTAGE (b) TRANSMITTANCE (a)

(b)

(c)

BRIGHTNESS DISTRIBUTIONS WITHIN PANEL SURFACE FOR EACH PERIOD OF FIG. 8

BRIGHTNESS DISTRIBUTION WITHIN PANEL SURFACE (OBSERVED) AVARAGED IN TIME OF FIG. 8

(a)

(b)

(c)

BRIGHTNESS DISTRIBUTIONS WITHIN PANEL SURFACE FOR EACH PERIOD OF FIG. 10

BRIGHTNESS DISTRIBUTION WITHIN PANEL SURFACE (OBSERVED) AVARAGED IN TIME OF FIG. 10

(a)

(b)

(c)

BRIGHTNESS DISTRIBUTIONS WITHIN PANEL SURFACE
FOR EACH PERIOD OF FIG. 12

BRIGHTNESS DISTRIBUTION WITHIN PANEL SURFACE
(OBSERVED) AVARAGED IN TIME OF FIG. 12

(a)

(b)

(c)

(a)

(b)

(c)

(a)

(b)

(c)

(a)

(b)

(c)

LIQUID CRYSTAL DISPLAY UNIT AND METHOD FOR DRIVING THE SAME

BACKGROUND OF THE INVENTION (a) Field of the Invention

The present invention relates to a liquid crystal display apparatus and a method of driving the same, and more particularly to a method of driving a liquid crystal display element which provides high contrast and high brightness and which is not affected by electrical asymmetry, as well as a liquid crystal display apparatus having a liquid crystal display element that is driven by such a method.

(b) Description of the Related Art

The mainstream of a high performance liquid crystal display apparatus is a TFT (thin-film transistor)-scheme active matrix liquid crystal display apparatus of a TN (twisted nematic) mode using nematic liquid crystal or an IPS (in-plane switching) mode. In such an active matrix liquid crystal display apparatus, an image is re-displayed at 60 Hz, because positive and negative image signals are written at 30 Hz, making the time period of one field about 16.7 ms (millisecond). The total of the time for writing the positive image signal and the time for writing the negative image signal is called a frame time, which is about 33.3 ms. By contrast, the response time of the fastest available liquid crystal is almost equal to the frame time. Therefore, display of an image including a motion picture or display of a high speed computer image requires a response speed faster than the current frame time.

Meanwhile, a field-sequential color liquid crystal display apparatus has been studied in an effort to increase resolution. In the field-sequential color liquid crystal display apparatus, the color of a back light of the liquid crystal display apparatus is sequentially switched among red, green, and blue. Since this method does not require that color filters be spatially disposed, the resolution can be increased to three times that of a conventional liquid crystal display apparatus. In the field-sequential color liquid crystal display apparatus, since an image for one color must be displayed within a period ⅓ that for one field, the time period that can be used for display is about 5 ms. Therefore, liquid crystal itself is required to have a response time shorter than 5 ms. Liquid crystal that causes spontaneous polarization, such as ferroelectric liquid crystal or antiferroelectric liquid crystal, has been studied as candidate liquid crystal capable of achieving such a high response speed. Further, in relation to nematic liquid crystal, various studies have been performed in an effort to improve a response speed through an increase in the degree of dielectric anisotropy, a decrease in viscosity and/or thickness, or employment of a pi-type liquid crystal orientation.

In an active matrix liquid crystal display element, the operation of storing a voltage and a charge in the liquid crystal section is actually performed only in a period during which each scan line is selected (write time). The write time is 16.7 μs (microsecond) in the case of a liquid crystal display apparatus which has 1000 lines and in which an image signal for the 1000 lines is written within one field time, and about 5 μs in the case of a liquid crystal display apparatus which is driven in a field sequential scheme. Presently, no known liquid crystal element or known manner of liquid crystal completes its response within the time period as described above. Even among liquid crystal elements that cause spontaneous polarization and nematic liquid crystal of improved response speed, no known element exhibits such quick response. This results in the problem that response of liquid crystal generally occurs after completion of signal write operation. Consequently, in liquid crystal elements that cause spontaneous polarization, a depolarization field is generated due to rotation of spontaneous polarization, so that voltages at opposite ends of a liquid crystal layer drop abruptly. Therefore, the voltages stored at the opposite ends of the liquid crystal layer change largely. Meanwhile, in the high speed nematic liquid crystal, change in the capacitance of a liquid crystal layer caused by anisotropy of dielectric constant increases considerably, resulting in a change in the voltage that is written into the liquid crystal layer and must be held constant. Such a decrease in the holding voltage; i.e., a decrease in the effective applied voltage, results in insufficient writing, so that the on-screen contrast decreases. Further, when the same signal is repeatedly written, the brightness continuously changes until lowering of the holding voltage stops, so that a few frames are required to obtain stable brightness.

"Japanese Applied Physics," Vol. 36, Part 1, No. 2, pp 720–729 reports that a so-called "step response" phenomenon occurs when an identical image signal is written over a few frames after a frame in which an image signal changes and thus the absolute value of a signal voltage changes. According to this phenomenon, for the same signal voltage, the transmittance of liquid crystal changes in the manner of damped oscillation over a few frames, so that the liquid crystal becomes bright in alternate frames and dark in other frames. After a few frames, the transmittance is stabilized at a predetermined level.

An example of the above phenomenon will be described with reference to FIGS. 1–3. FIG. 1(*a*) is chart showing the waveform of a data voltage; and FIG. 11(*b*) is a chart showing change in transmittance at that time. When the data voltage shown in FIG. 1(*a*) is applied to liquid crystal, as shown in FIG. 1(*b*), the transmittance of liquid crystal changes in the manner of damped oscillation such that the liquid crystal becomes alternately light and dark. In the illustrated example, the transmittance of the liquid crystal converges to a constant level in the fourth frame. Since the liquid crystal requires a few frames to change its transmittance as described above, high speed display of images is impossible.

FIG. 2(*a*) is a chart showing the waveform of a data voltage; FIG. 2(*b*) is a chart showing change in a gate voltage; and FIG. 2(*c*) is a chart showing change in transmittance at that time. FIG. 3 is a timing chart for scan lines in the drive shown in FIG. 2. The color shade during each of positive and negative display periods 102 and 104 represents brightness corresponding to the transmittance of FIG. 2. In FIG. 3, a time period of 16.7 ms is indicated by an arrow.

FIG. 3 depicts six scan lines. Positive writing 101 is successively performed from the top scan line in order to obtain a positive display 102, and then negative writing 103 is successively performed from the top scan line in order to obtain a negative display 104. In each scan line, the period of the positive writing 101 and the period of the positive display 102 constitute a first field, while the period of the negative writing 103 and the period of the negative display 104 constitute a second field. The first and second fields constitute one frame.

When the data voltage of FIG. 2(*a*) is applied and a TFT switch is turned on by the gate voltage of FIG. 2(*b*), as shown in FIG. 2(*c*), the transmittance of liquid crystal changes in the manner of damped oscillation such that the liquid crystal becomes alternately light and dark. This is observed as flicker, which has the effect of deteriorating the quality of display. Further, as shown in FIG. 2(*c*), the transmittance of the liquid crystal converges to a constant level in the second frame (fourth field) following application of the signal voltage.

As a result, the brightness changes in an oscillating manner, as shown in FIG. 3. As described above, even when liquid crystal of high response speed is used, the speed of a display image decreases, because a few frames are required to stabilize the brightness.

The transmittance of liquid crystal after response is determined not by an applied signal voltage but by the amount of charge stored in the liquid crystal serving as a capacitor. The amount of charge depends on a total amount of accumulated charge that exists before the signal is written and of charge that is newly written. The amount of charge accumulated after response also changes depending on design values in relation to pixels such as the physical constants of liquid crystal, electric parameters and an amount of charge accumulation. Therefore, in order to establish correspondence between a signal voltage and transmittance, data, actual calculation, and the like are required for determining (1) the relationship between the signal voltage and an amount of stored charge, (2) an amount of charge present before signal writing operation, and (3) an amount of charge present after response. Therefore, there becomes necessary a frame memory for storing the data regarding (2) for the entire screen, and a calculation section for calculating the data (1) and (3). This is not preferred, because the number of parts of the system increases.

In order to solve the above problem, there is sometimes used a reset pulse scheme, in which a reset voltage is applied to liquid crystal so as to bring the liquid crystal into a predetermined state before new data are written therein.

As an example, a technique described in IDRC, pp. 66–69, 1997 will be described. This technique uses an OCB (optically compensated bi-refligence) mode in which nematic liquid crystal is aligned to obtain a pi-type alignment, and compensation film is attached to the liquid crystal. The response speed of the liquid crystal mode is about 2 to 5 msec, which is considerably faster than that of a conventional TN mode.

Although response is theoretically considered to be completed within one frame, as described above, a few frames are required for attainment of stable transmittance, because a holding voltage greatly decreases due to change in dielectric constant caused by response of the liquid crystal. A method for solving this problem is shown in FIG. 5 of the above literature. In this method, within one frame, a signal for black display is always written after a signal for white display is written. FIG. 5 of the literature is reproduced as FIG. 4. The horizontal axis represents time, while the vertical axis represents brightness. A dotted line shows variation in brightness for the case of ordinary drive and indicates that the brightness reaches a stable level in the third frame.

When the reset pulse scheme is employed, liquid crystal always attains a predetermined state before new data are written therein, and one-to-one correspondence can be observed between a written signal voltage and an obtained transmittance. This one-to-one correspondence simplifies the manner of generation of drive signals and obviates a frame memory or other means for storing previous written information.

In order to apply a reset voltage to liquid crystal, there is used another method which comprises the steps of generating positive and negative data signal voltages for a certain image signal; applying to the liquid crystal the positive (negative) voltage and then the negative (positive) voltage; and subsequently applying a reset voltage to the liquid crystal. In this case, if the positive and negative data signal voltages having the same amplitude are applied, the "step response" as described above occurs. Therefore, a data signal voltage having a waveform shown in FIG. 5(*a*) is applied to liquid crystal. FIG. 5(*b*) is a graph showing a variation in transmittance observed at that time. The waveform of a data signal voltage whose negative and positive values have the same amplitude is indicated by a dotted line in FIG. 5(*a*), and a variation in transmittance when the data signal voltage of FIG. 5(*a*) is applied to liquid crystal is indicated by a dotted line in FIG. 5(*b*).

In order to avoid "step response," as shown in FIG. 5(*a*), the amplitude of a data voltage in a first half of a frame (a positive data voltage in this example) is made small, and the amplitude of the data voltage in a second half of the frame (a negative data voltage in this example) is made equal to that of the waveform indicated by the dotted line. This setting prevents step response, so that, as shown in FIG. 5(*b*), the same transmittance is obtained in the first and second halves of the frame. By the subsequent step of resetting the liquid crystal at the end of the frame, the liquid crystal is brought into a predetermined reset state. In a subsequent frame, a new signal voltage having a similar waveform is applied, so that the transmittance of the liquid crystal changes in accordance with the new signal voltage. In this manner, one-to-one correspondence is established between the constant signal voltage and the constant transmittance.

Further, in order to solve these problems, there has been proposed a drive method called "pseudo DC-drive" shown in AMLDC, 97 digest, pp. 119–122.

This technique will be described with reference to FIGS. 6 and 7. Similar to FIG. 2, FIG. 6(*a*) is a chart showing the waveform of a data voltage; FIG. 6(*b*) is a chart showing change in a gate voltage; and FIG. 6(*c*) is a chart showing change in transmittance at that time. FIG. 7 is a timing chart for each scan line, and the color shade in each of positive and negative display periods 102 and 104 represents brightness corresponding to the transmittance of FIG. 6(*c*). In FIG. 6, a time period of 16.7 ms is indicated by an arrow.

In the literature, a period of 16.7 ms is defined as one frame period. However, since this definition is not generally accepted, the period is changed in the drawings of the present specification (one frame period described in the literature corresponds to one field period used in the present specification with regard to ordinary conventional techniques).

In the "pseudo DC-drive" unlike the case of AC drive as shown in FIG. 2, a data voltage of the same polarity is continuously applied to liquid crystal over a plurality of fields. After the plurality of fields, the polarity of the data voltage is reversed so as to eliminate electrical imbalance. In FIG. 6, after positive writing over four fields, negative writing is performed over four fields to complete display of one image signal. Since writing is performed for each scan line at timing as shown in FIG. 7, an operation of successively writing positive data from the top line is repeated four times, and then an operation of successively writing negative data from the top line is repeated four times.

This method enables attainment of a state in which voltages held at opposite ends of liquid crystal become the same as a constant applied DC voltage. As a result, the holding voltage does not decrease due to response of liquid crystal, and the final transmittance becomes higher than that in the case of AC drive shown in FIG. 2, in which the holding voltage decreases due to response of liquid crystal.

However, in this method, one frame period becomes equal to the total of a plurality of frames of different polarities. That is, in the example shown in FIG. 6, the length of one frame is four times that of the frame in FIG. 2.

Even if any of the reset pulse schemes described above is employed, the conventional reset pulse method has the following problems. First, brightness changes greatly depending on position within a screen which is effected by the timing when the reset operation is performed. For example, when scanning is performed from the top of the screen toward the bottom of the screen, and the reset operation is performed after completion of scanning of all lines; at the top of the screen, a period substantially corresponding to one field is available as a display time after the writing operation, but at the bottom of the screen, only a very short time is available as the display time after the writing operation. This phenomenon is described with reference to FIG. 8.

FIG. 8(*a*) schematically shows states in a write (scanning) period 101, a display period 102, and a reset period 103 in two dimensions; i.e., the scanning direction of a screen and time axis. In this Figure, eight scan lines are shown, and in the write period 101, scanning is performed successively from the top of the screen toward the bottom thereof. After the display period 102 having a predetermined length, the entire screen is reset at a time during the reset period 103. FIG. 8(*b*) schematically shows a scan line voltage and transmittance in the uppermost part of the display or on a first (No.1) scan line when white color is displayed by use of the drive method as described above. FIG. 8(*c*) schematically shows a scan line voltage and transmittance in the lowermost part of the display or on an eighth (No.8) scan line. In the first scan line, white is displayed during a relatively long period corresponding to a value equal to one frame period less the sum of the reset period and a transient response period. However, in the eighth scan line, since the reset is started simultaneously with the end of the response period, white cannot be displayed sufficiently. As a result, when the entire frame period is considered, as shown in FIG. 9B, there occurs a phenomenon that the top portion of the screen is bright and the bottom portion of the screen is dark. Such a brightness variation within the screen deteriorates image quality considerably.

Next, since the period for bringing the liquid crystal into a predetermined display state always exists, the overall contrast and the maximum transmittance decrease. For example, if the liquid crystal is reset such that the liquid crystal display turns to black, a period available for displaying a certain color other than black becomes shorter than that available when no reset operation is performed, so that the maximum transmittance and the transmittance at each gradation both decrease. If the liquid crystal is reset such that the liquid crystal displays a color other than black, the transmittance at the time of the reset is added when black is displayed and is averaged with respect to time, with the result that the transmittance at the time of black being displayed is increased, and the contrast decreases.

Further, since the period during which the transmittance of the liquid crystal attains a constant level always exists, flicker is generated between that transmittance and a transmittance occurring at the time of another color being displayed. For example, when the entire screen is reset concurrently, flickering occurs over the entire screen, so that a great degree of flicker is observed.

Moreover, the scanning period decreases by an amount corresponding to the length of the reset period. In general, the scanning period (write time) is substantially equivalent to a time obtained through division of the field time, which is half the frame time, by the number of scan lines. However, if a reset period is provided in the field time, the scanning period 101 shown in FIG. 8(*a*) decreases to a time obtained through division of (the field time minus the reset time 103) by the number (8) of scan lines. As a result, the scanning period becomes shorter. In order to solve the problem that the reset period affects the scanning period, there has been proposed a method in which interlace drive is combined with reset, as shown in, for example, Patent Publication JP-A-92-186217. In this method, a FLC (ferroelectric liquid crystal) panel is driven in an interlace mode, and scan lines are reset in their respective non-display periods. This prevents a decrease in the length of the scanning period. Further, the reset timings of adjacent lines are shifted from each other, and the degree of flicker is considered to decrease due to averaging. However, even when this method is used, the remaining problems, such as variation of brightness within the screen and decrease in the maximum transmittance, cannot be solved.

Meanwhile, in the pseudo DC-drive, as described above, a longer frame period (in the example of FIGS. 6 and 7, a period four times that of an AC drive) is required compared to the AC drive, so that high responsiveness of the liquid crystal cannot be exploited effectively. Consequently, flicker of a long period, which fluctuates at a period a few times that of the ordinary frame period (16.7 ms), is generated of which brightness is shown in FIG. 7.

SUMMARY OF THE INVENTION

In view of the foregoing, an object of the present invention is to provide a method for driving a fast response liquid crystal display apparatus, which method decreases in-plane brightness difference and flicker caused by employment of reset pulses, and which realizes high contrast and high brightness.

Another object of the present invention is to provide a liquid crystal display apparatus which is driven by the drive method and which has increased response speed, contrast, and brightness, and reduced in-plane brightness difference and flicker.

Still another object of the present invention is to provide a method for driving a liquid crystal element which realizes one-to-one correspondence between an applied signal voltage and transmittance without use of a reset-pulse method or a frame memory.

Yet another object of the present invention is to provide a method for driving a liquid crystal element which realizes one-to-one correspondence between an applied signal voltage and transmittance and enables a high-speed response. A further object of the present invention is to provide liquid crystal display apparatuses that employ these drive methods.

In order to achieve the above objects, the present invention provides in a method for driving a liquid crystal display apparatus comprising the steps of scanning successively scan lines for display and resetting the scan lines in each field, the improvement wherein the scan lines are simultaneously reset after the scan lines are successively scanned in a first field, and the scan lines are simultaneously reset after the scan lines are successively scanned in a second field in an order reverse to that in the first field (hereinafter referred to as a first invention).

According to the liquid crystal driving method of the first invention, since the time from writing to reset can be averaged throughout a display panel, a uniform in-plane brightness variation is obtained.

When interlace drive is effected by the method of the first invention, preferably odd scan lines are scanned successively, e.g., from top to bottom, in a first frame, and even scan lines are scanned successively in the reverse direction, e.g., from bottom to top, in a second frame.

When the interlace drive is employed, it is also preferred that in each frame, two write periods be provided for each scan line and two reset periods be provided for each scan line. The method may be modified such that in each frame one reset period is provided for each scan line, and a data signal voltage used in a first writing operation after the reset has an absolute value smaller than that of a data signal voltage used in a second writing operation.

According to the first invention, there can be realized a method which is suitable for a fast response liquid crystal display apparatus that uses reset pulses, which can decrease in-plane brightness variation and flicker, while realizing high contrast and high brightness, and which is not affected by electrical asymmetry. Further, according to the first invention, a liquid crystal display apparatus and a field-sequential liquid crystal display apparatus which employ the method of driving can be realized.

In order to achieve the above objects, the present invention also provides a method for driving a liquid crystal display element (hereinafter referred to as a first method of driving), in which each frame comprises a first field and a second field;

data are written a plurality of times in the first field by use of a predetermined signal voltage; and data are written a plurality of times in the second field by use of a signal voltage whose polarity is reversed (hereinafter referred to as a second invention).

Another method (hereinafter referred to as a second drive method) for driving a liquid crystal element according to the present invention is characterized in that data are written a plurality of times in each frame by use of a signal whose polarity becomes alternately positive and negative at a predetermined frequency (hereinafter referred to as a third invention).

Third and fourth methods for driving are derived from the second and third invention, respectively, and are characterized in that a group of scan lines are divided into a plurality of blocks, and the plurality of blocks are scanned simultaneously.

Further, each of fifth and sixth methods for driving is employed by a field-sequential liquid crystal display apparatus in which each frame is divided into three fields corresponding to three colors, and data are successively written for display within each field, characterized in that the method for driving each color is either the third or fourth method for driving.

The first method for driving corresponds to the pseudo DC driving method in which the drive frequency is increased, whereby writing operation is performed a plurality of times within each field by AC drive.

The second method for driving corresponds to the AC method for driving in which the drive frequency is increased, whereby AC drive is performed a plurality of periods within each frame.

The third method for driving is a variation of the first method for driving and is characterized in that a group of scan lines are divided into a plurality of blocks, and the plurality of blocks are scanned simultaneously. The fourth method for driving is a variation of the second method for driving and is characterized in that a group of scan lines are divided into a plurality of blocks, and the plurality of blocks are scanned simultaneously.

The fifth method for driving derived from the second or third invention is for field sequential display and is characterized in that liquid crystal is driven in the same manner as in the first and third method for driving, and for each color, there are provided a plurality of positive writing operations, a display period subsequent thereto, a plurality of negative writing operations, and a display period subsequent thereto.

The sixth method for driving derived from the second or third invention is for field sequential display and is characterized in that liquid crystal is driven in the same manner as in the second and third method for driving, and for each color, there are provided a plurality of AC drive operations and a display period subsequent thereto.

A liquid crystal display apparatus according to the second or third invention is a liquid crystal display apparatus that utilizes the method for driving according to any one of the first to fourth methods for driving. Another liquid crystal display apparatus according to the second or third invention is a field-sequential liquid crystal display apparatus that utilizes the method for driving according to the fifth or sixth method and is characterized in that view-angle dependency of liquid crystal display mode and in-plane brightness variation caused by the method for driving are cancelled out.

According to the second and third invention, there can be realized a method for driving which is suitable for a fast response liquid crystal display apparatus which can drive a liquid crystal element without use of reset pulses and without calculation between image data sets, which realizes high contrast and high brightness, and which is not affected by electrical asymmetry. Further, there are realized a liquid crystal display apparatus and a field-sequential liquid crystal display apparatus which employ the method for driving.

BRIEF DESCRIPTION OF THE DRAWINGS

FIG. 9 is charts showing distribution of brightness within a panel surface driven by the conventional method, wherein

FIG. 11 is charts of distribution of brightness within a panel surface showing operation of the first embodiment, wherein

FIG. 13 is charts of distribution of brightness within a panel surface showing operation of the second embodiment, wherein

FIG. 15 is charts showing distribution of brightness within a panel surface averaged with respect to frame time and showing operation of the third to fifth embodiments of the present invention, wherein

FIG. 19 is charts showing the structure and operation of eighth and ninth embodiments of the present invention, wherein

DESCRIPTION OF THE PREFERRED EMBODIMENTS

Figure 1:
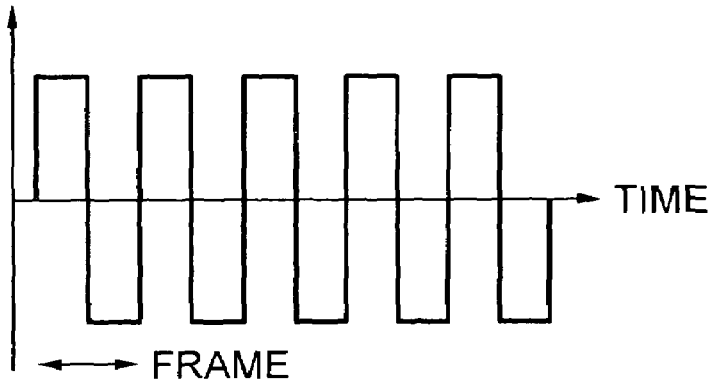
FIG. 1 PRIOR ART
FIGS. 1(*a*) and 1(*b*) are charts for describing a step response in conventional fast response liquid crystal, wherein FIG. 1(*a*) shows the waveform of an applied voltage, and FIG. 1(*b*) shows variation in transmittance upon application of the applied voltage of FIG. 1(*a*).
Figure 1:
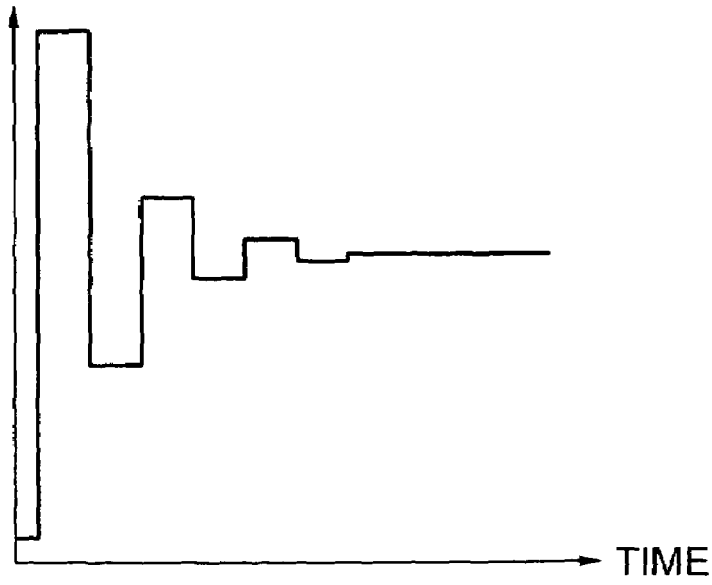
FIG. 1 PRIOR ART

Then, the present invention will be described in further detail by the description of embodiments and examples of the first invention with reference to the accompanying drawings. The same periods as those described in relation to the prior art are denoted by the same reference numerals and their detailed description will be omitted.

First Embodiment

Figure 10:
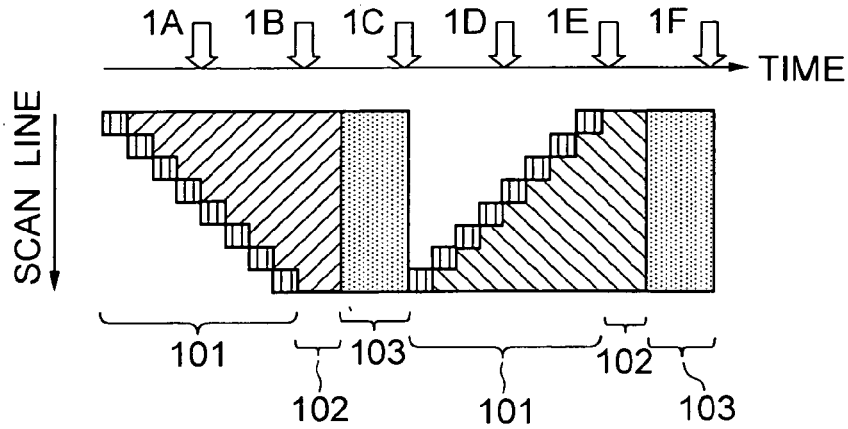
FIG. 10 is charts showing the structure and operation of a first embodiment of the present invention, wherein FIG. 10(*a*) shows a time chart for each scan line, FIG. 10(*b*) shows the waveform of a voltage applied for a first scan line and variation in transmittance at that time, and FIG. 10(*c*) shows the waveform of a voltage applied for an eighth scan line and variation in transmittance at that time.
Figure 10:
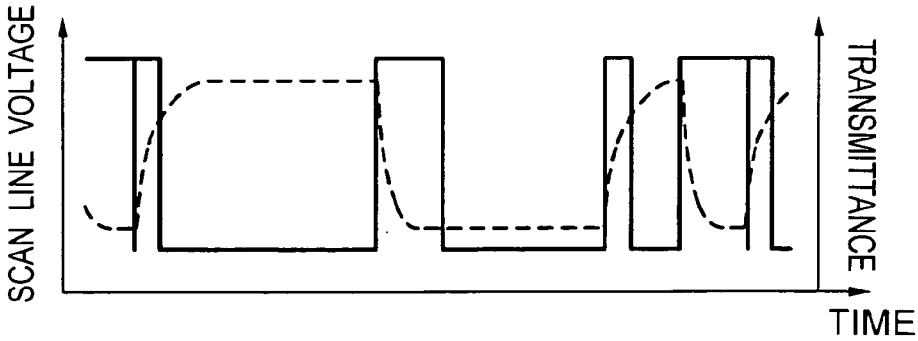
Figure 10:
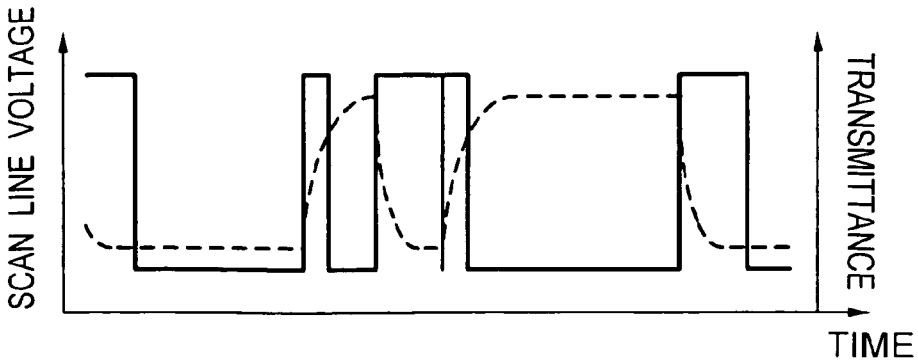

FIG. 10 is charts showing a method for driving according to a first embodiment of the first invention. FIG. 10(*a*) is a time chart showing time allotment for each scan line, wherein the horizontal axis is a time axis, and the vertical axis shows the positions of scan lines. FIG. 10(*b*) shows an exemplary case where eight scan lines are provided. FIG. 10(*b*) is a time chart showing the waveform of a voltage applied for the first scan line and variation in transmittance at that time, and FIG. 10(*c*) is a time chart showing the waveform of a voltage applied for the eighth (final) scan line and variation in transmittance at that time.

In the present embodiment, scan lines are successively selected and data therefor are written into liquid crystal during a write period 101, and display is provided during a display period 102. Subsequently, all the scan lines are reset during a reset period 103. The sequence or order in which the scan lines are scanned in the first field of each frame is different from that in the second field of the frame. Specifically, in the first field, the scanning is performed downward from the first scan line to the eighth scan line, and in the second field, the scanning is performed upward from the eighth scan line to the first scan line. The scanning in the first and second fields may be performed in sequences opposite to the respective sequences described above.

As shown in FIG. 10(*b*), with respect to the first scan line, a scanning signal for writing is applied to the liquid crystal at the beginning of the first field, and a scanning signal for resetting is applied to the liquid crystal at the end of the first field. In the second field, a write signal is applied to the liquid crystal slightly before the end of the second field, and a reset signal is applied to the liquid crystal at the end of the second field. By contrast, as shown in FIG. 10(*c*), with respect to the eighth scan line, a write signal is applied to the liquid crystal slightly before the end of the first field, and a reset signal is applied to the liquid crystal at the end of the first field. In the second field, a write signal is applied to the liquid crystal at the beginning of the second field, and a reset signal is applied to the liquid crystal at the end of the second field. In the example shown in FIGS. 10(*b*) and 10(*c*), the write signal has a level for displaying white (high transmittance), and the reset signal has a level for displaying black (low transmittance). However, the transmittance resulting from the writing operation changes depending on actually written data.

With respect to the first scan line, the transmittance starts to increase from the beginning of the first field, reaches the maximum after completion of the write operation, and decreases to the minimum during the reset period at the end of the field. In the second field, the transmittance starts to increase from a point slightly before the end of the field, reaches the maximum after completion of the write operation, and decreases to the minimum during the reset period immediately after the transmittance has reached the maximum. By contrast, with respect to the eighth scan line, the transmittance starts to increase from a point slightly before the end of the first field, reaches the maximum after completion of the write operation, and decreases to the minimum during the reset period immediately after the transmittance has reached the maximum. In the second field, the transmittance starts to increase from the beginning of the field, reaches the maximum after completion of the write operation, and decreases to the minimum during the reset period at the end of the field.

Figure 11A:
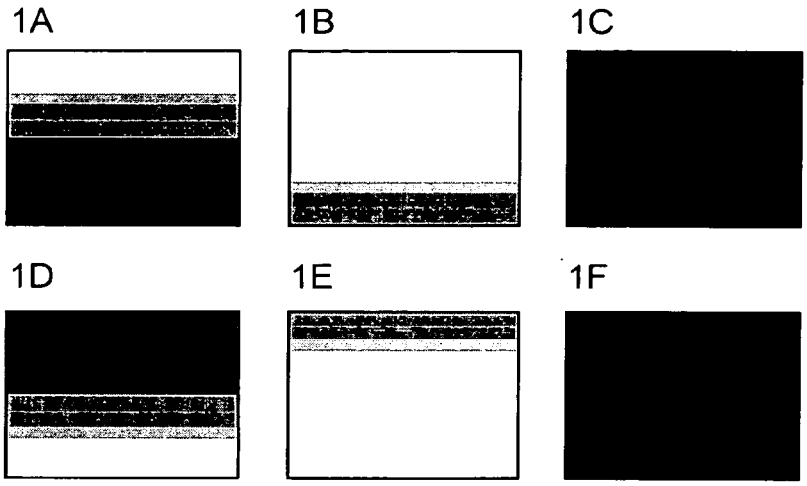
FIG. 11A shows brightness distributions at times 1A–1F in FIG. 10(*a*)
Figure 11B:
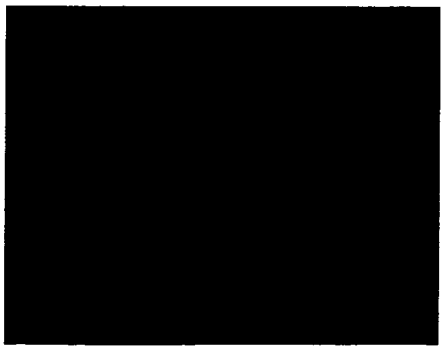
FIG. 11B shows a brightness distribution averaged within a frame time.

FIG. 11A shows a distribution of brightness within a screen of a liquid crystal display panel driven by the method shown in FIGS. 10(*a*)–10(*c*). Screens 1A, 1B, and 1C respectively correspond to times 1A, 1B, and 1C shown in FIG. 10(*a*) and respectively show a brightness distribution at the beginning of the write period of the first field, a brightness distribution at the later part of the write period of the first field, and a brightness distribution at the end of the first field. Similarly, screens 1D, 1E, and 1F respectively correspond to times 1D, 1E, and 1F shown in FIG. 10(*a*) and respectively show a brightness distribution at the beginning of the write period of the second field, a brightness distribution at the later part of the write period of the second field, and a brightness distribution at the end of the second field. FIG. 11B shows an actually observed brightness distribution; i.e., a brightness distribution averaged with respect to time over the frame time. As shown in FIG. 11A, at times 1A and 1B of the first field, the top portion of the screen becomes brighter than the bottom portion thereof, reflecting the changes in transmittance shown in FIG. 10(*c*), and at times 1D and 1E of the second field, the bottom portion of the screen becomes brighter than the top portion thereof. Further, at times 1C and 1F at the ends of the respective fields, the entire screen becomes black. As described above, the brightness distribution within the screen changes greatly every moment. However, as is apparent from FIG. 11B, which shows the averaged brightness distribution, the brightness distributions at different moments are averaged, so that the observed brightness is uniform over the entire screen.

Second Embodiment

Figure 12:
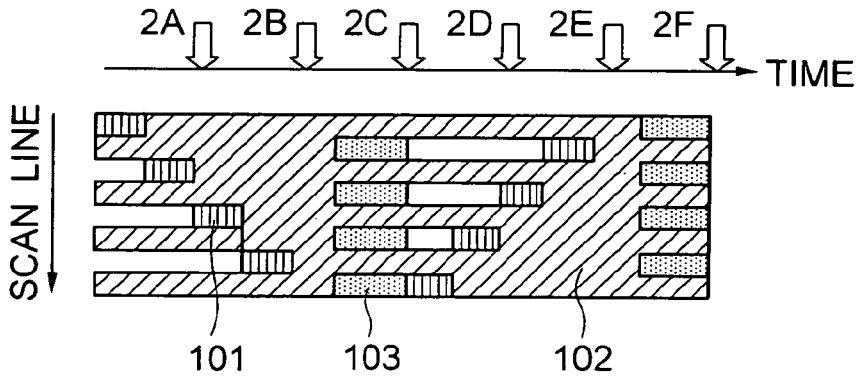
FIG. 12 is charts showing the structure and operation of a second embodiment of the present invention, wherein FIG. 12(*a*) shows a time chart for each scan line, FIG. 12(*b*) shows the waveform of a voltage applied for the first scan line and variation in transmittance at that time, and FIG. 12(*c*) shows the waveform of a voltage applied for the eighth scan line and variation in transmittance at that time.
Figure 12:
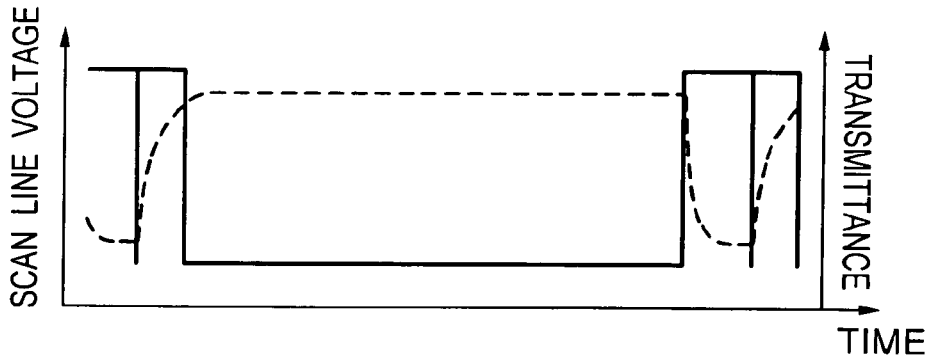
Figure 12:
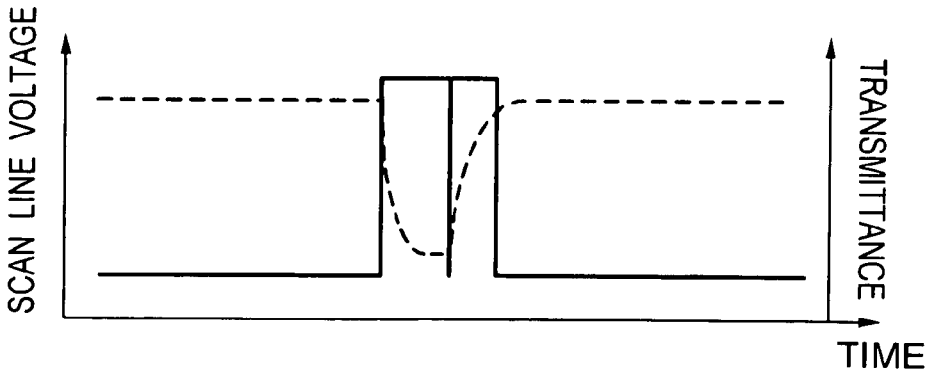

FIGS. 12(*a*)–12(*c*) are time charts that show a second embodiment of the present invention in the same manner as in FIGS. 10(*a*)–10(*c*). In the present embodiment, bi-directional scanning is performed as in the first embodiment. However, the present embodiment differs from the first embodiment in that the position of the reset period is changed from that in the first embodiment, and interlace drive is employed. In the present embodiment, one half of the eight scan lines (odd-numbered scan lines, hereinafter called "odd scan lines") are scanned (selected) in the first field, and the remaining half of the eight scan lines (even-numbered scan lines, hereinafter called "even scan lines") are scanned (selected) in the second field. The reset period 103 for each scan line is positioned at the end of the field in which the scan line is not scanned (selected). Specifically, for odd scan lines, a write period 101 is provided in the first field such that these scan lines are successively scanned from the top for write operation, followed by a display period 102. A reset period 103 is provided at the end of the second field. For even scan lines, a reset period 103 is provided at the end of the first field, and a write period 101 is provided in the second field such that these scan lines are successively scanned from the bottom for write operation, followed by a display period 102. Another reset period is provided at the end of the first field of the next frame (unillustrated).

In the first field, the odd scan lines as counted from the top are successively scanned from the top, and in the second field, the even scan lines as counted from the top are successively scanned from the bottom. Specifically, with respect to the first scan line, a write signal is applied to the liquid crystal at the beginning of the first field, and a reset signal is applied to the liquid crystal at the end of the second field. Therefore, the transmittance starts to increase from the beginning of the first field, reaches the maximum after completion of the write operation, and decreases to the minimum during the reset period at the end of the second field. By contrast, with respect to the eighth scan line, a reset signal is applied to the liquid crystal at the end of the first field, and a write signal is applied to the liquid crystal at the beginning of the second field. Therefore, the transmittance reaches the minimum at the end of the first field, starts to increase at the beginning of the second field, and reaches the maximum after completion of the write operation.

Figure 13A:
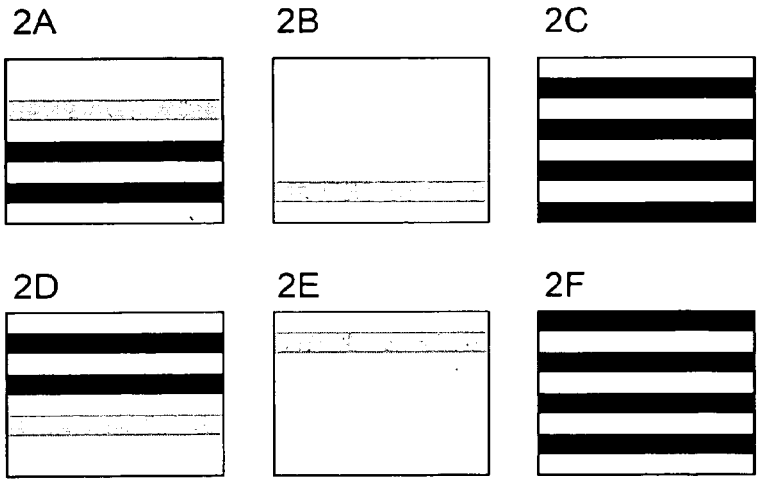
FIG. 13A shows brightness distributions at times 2A–2F in FIG. 12(*a*)
Figure 13B:
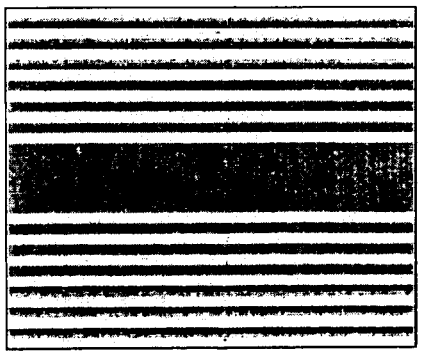
FIG. 13B shows a brightness distribution averaged within a frame time.

FIGS. 13A and 13B show brightness distributions in a liquid crystal display panel of the second embodiment, in the same manner as in FIGS. 11A and 11B. Screens 2A–2F in FIG. 13A respectively correspond to times 2A–2F shown in FIG. 12(*a*). In the first field, as shown in FIG. 13A, at the beginning and the end of the write period, the even scan lines are displayed such that they are always bright and the odd scan lines are displayed such that the top portion of the screen becomes brighter than the bottom portion thereof. In the second field, at the beginning and the end of the write period, the odd scan lines are displayed such that they are always bright and the even scan lines are displayed such that the bottom portion of the screen becomes brighter than the top portion thereof. At the end of the first field, the even scan lines become black, and the odd scan lines become white. By contrast, at the end of the second field, the odd scan lines become black, and the even scan lines become white. As described above, the brightness distribution within the screen changes greatly every moment. However, as is apparent from FIG. 13B, which shows the averaged brightness distribution, the variation in brightness distribution within the screen is mitigated greatly. Although stripes having different brightnesses and corresponding to the scan lines are formed at the top and bottom portions of the screen, such stripes are hardly formed at the central portion of the screen. Since the pitch of the scan lines is very small in an actual screen, the brightnesses of the strips are averaged spatially, so that substantially uniform brightness is obtained over the entire screen.

The second embodiment has an advantage that the brightness becomes considerably high as compared with the brightness obtained in the first embodiment and shown in FIG. 11B. Further, since flicker is generated at different timings between the odd lines and the even lines of the interlace drive, the degree of observed flicker decreases due to averaging between the lines. Further, since there exists no period during which the entire screen becomes black, the degree of flicker decreases further.

Third Embodiment

Figure 14:
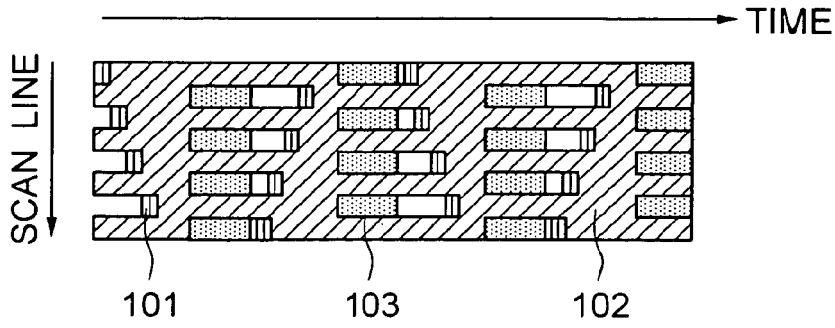
FIG. 14 is charts showing the structure and operation of a third embodiment of the present invention, wherein FIG. 14(*a*) shows a time chart for each scan line, FIG. 14(*b*) shows the waveform of a voltage applied for the first scan line and variation in transmittance at that time, and FIG. 14(*c*) shows the waveform of a voltage applied for the eighth scan line and variation in transmittance at that time.
Figure 14:
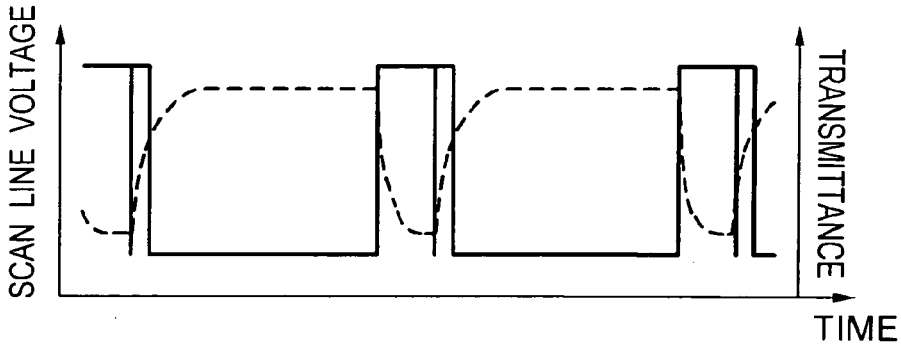
Figure 14:
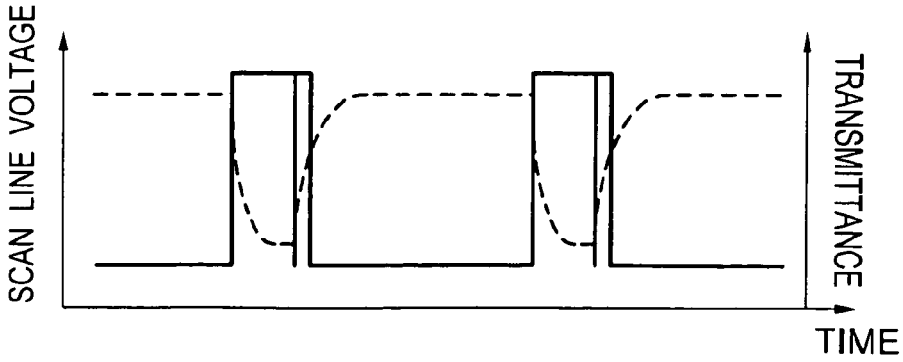

FIGS. 14(*a*)–14(*c*) are time charts that show a third embodiment of the present invention in the same manner as in FIGS. 10(*a*)–10(*c*). In the present embodiment, bi-directional scanning is performed in combination with interlace drive as in the second embodiment. The method for driving of the present embodiment can be achieved through modification of the method for driving of the second embodiment such that the frame frequency is doubled. That is, as shown in FIG. 10(*a*), for odd scan lines, a write period 101 is provided in a first half of the first field such that these scan lines are successively scanned from the top for write operation, followed by a display period 102. A reset period 103 is provided at the end of the first field. The second field is similarly divided into these periods. By contrast, for even scan lines, a reset period 103 is provided at the end of the first half of the first field, a write period 101 is provided in the second half of the first field such that these scan lines are successively scanned from the bottom for write operation, and a display period 102 follows. The second field is similarly divided into these periods. Another reset period is provided at the end of the first half of the first field of the next frame (unillustrated).

As shown in FIG. 14(*b*), with respect to the first scan line, a write signal is applied to the liquid crystal at the beginning of the first field, a reset signal is applied to the liquid crystal at the end of the first field, a write signal is applied to the liquid crystal at the beginning of the second field, and a reset signal is applied to the liquid crystal at the end of the second field. Therefore, the transmittance starts to increase from the beginning of the first field, reaches the maximum after completion of the write operation, and reaches the minimum during the reset period at the end of the first field. The transmittance again starts to increase from the beginning of the second field, reaches the maximum after completion of the write operation, and reaches the minimum during the reset period at the end of the second field. As shown in FIG. 14(*c*), with respect to the eighth scan line, a reset signal is applied to the liquid crystal at the end of the first half of the first field, a write signal is applied to the liquid crystal at the beginning of the second half of the first field, a reset signal is applied to the liquid crystal at the end of the first half of the second field, and a write signal is applied to the liquid crystal at the beginning of the second half of the second field. Therefore, the transmittance reaches the minimum at the end of the first half of the first field, starts to increase at the beginning of the second half of the first field, and reaches the maximum after completion of the write operation. The transmittance again reaches the minimum at the end of the first half of the second field, starts to increase at the beginning of the second half of the second field, and reaches the maximum after completion of the write operation.

Figure 15A:
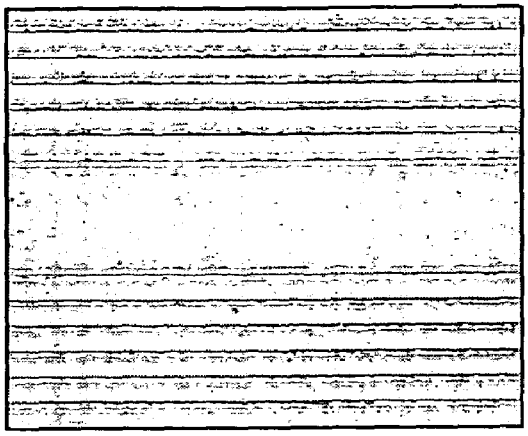
FIG. 15A shows a distribution in the third embodiment.

FIG. 15A shows a brightness distribution actually observed and averaged in frame time in a liquid crystal display panel according to the third embodiment. The method for driving of the third embodiment mitigates variation in brightness which is observed on a screen of a liquid crystal display panel driven by the conventional method for driving of FIG. 9B. In the present embodiment, since the reset period is provided twice in each frame, the brightness obtained in the present embodiment is lower than that obtained in the second embodiment. Other characteristics are mostly the same as those obtained in the second embodiment. However, the present embodiment greatly differs from the second embodiment in terms of electrical asymmetry. According to the method for driving of the first embodiment shown in FIG. 10, in many cases the length of the display period 102 in the first field differs from that in the second field. Therefore, if the method for driving of the first embodiment is used for liquid crystal that causes spontaneous polarization, such as ferroelectric liquid crystal or antiferroelectric liquid crystal, electrical asymmetry is likely to be produced due to depolarization field generated by polarized poles, which is a cause of image sticking stemming from ions. Further, in the method for driving of the second embodiment shown in FIG. 12, since the write period is provided only one time in each frame, electrical asymmetry is produced depending on the polarity of the written data signal. By contrast, in the present embodiment, the length of the display period 102 in the first field is identical to that in the second field, and data signals of opposite polarities can be written for the first and second fields. Therefore, no electrical asymmetry is produced, and image sticking does not occur.

Fourth Embodiment

Figure 16:
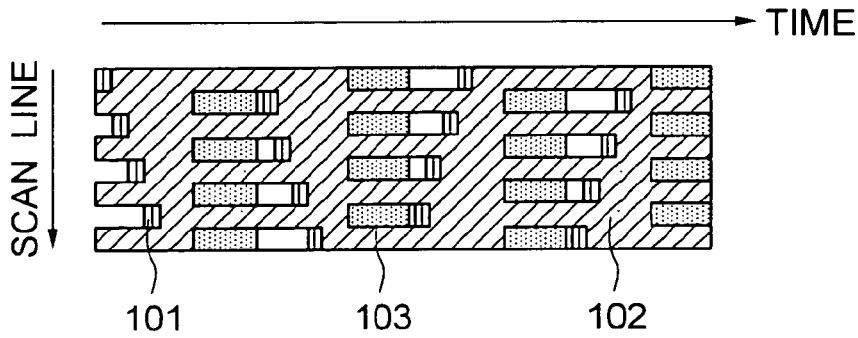
FIG. 16 is charts showing the structure and operation of a fourth embodiment of the present invention, wherein FIG. 16(*a*) shows a time chart for each scan line, FIG. 16(*b*) shows the waveform of a voltage applied for the first scan line and variation in transmittance at that time, and FIG. 16(*c*) shows the waveform of a voltage applied for the eighth scan line and variation in transmittance at that time.
Figure 16:
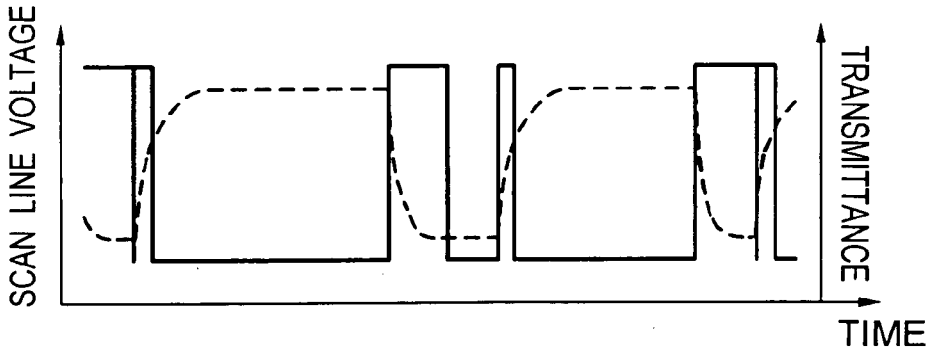
Figure 16:
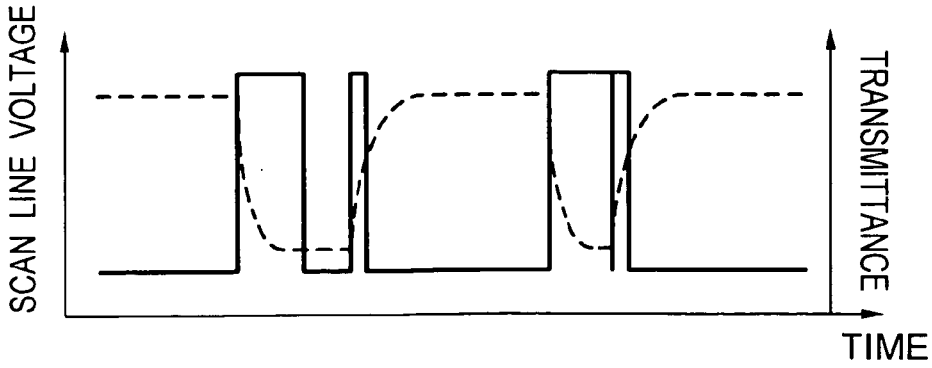

FIGS. 16(*a*)–16(*c*) are time charts that show a fourth embodiment in the same manner as in FIGS. 10(*a*)–10(*c*). In the present embodiment, bi-directional scanning is performed in combination with interlace drive as in the second and third embodiments. However, the present embodiment differs from the second and third embodiments in that the interlace drive is performed within each of the first and second fields, but the scanning direction in the second field is opposite to that in the first field. That is, for odd scan lines, a write period 101 is provided in a first half of the first field such that these scan lines are successively scanned from the top, followed by a display period 102, and a reset period 103 is provided at the end of the first field. Subsequently, a write period 101 is provided in a first half of the second field such that these scan lines are successively scanned from the bottom, followed by a display period 102, and a reset period 103 is provided at the end of the second field. By contrast, for even scan lines, a reset period 103 is provided at the end of the first half of the first field, and a write period 101 is provided in the second half of the first field such that these scan lines are successively scanned from the top, followed by a display period 102. Subsequently, a reset period 103 is provided at the end of the first half of the second field, and a write period 101 is provided in the second half of the second field such that these scan lines are successively scanned from the bottom, followed by a display period 102. Another reset period is provided at the end of the first half of the first field of the next frame (unillustrated).

As shown in FIG. 16(*b*), with respect to the first scan line, a write signal is applied to the liquid crystal at the beginning of the first field, a reset signal is applied to the liquid crystal at the end of the first field, a write signal is applied to the liquid crystal at a point slightly before the end of the second field, and a reset signal is applied to the liquid crystal at the end of the second field. Therefore, the transmittance starts to increase from the beginning of the first field, reaches the maximum after completion of the write operation, and reaches the minimum during the reset period at the end of the first field. The transmittance again starts to increase at a point slightly before the end of the first half of the second field, reaches the maximum after completion of the write operation, and reaches the minimum during the reset period at the end of the second field. As shown in FIG. 16(*c*), with respect to the eighth scan line, a reset signal is applied to the liquid crystal at the end of the first half of the first field, a write signal is applied to the liquid crystal at a point slightly before the end of the second half of the first field, a reset signal is applied to the liquid crystal at the end of the first half of the second field, and a write signal is applied to the liquid crystal at the beginning of the second half of the second field. Therefore, as shown in FIG. 16(*c*), the transmittance reaches the minimum at the end of the first half of the first field, starts to increase at the point slightly before the end of the second half of the first field, and reaches the maximum after completion of the write operation. The transmittance again reaches the minimum at the end of the first half of the second field, starts to increase at the beginning of the second half of the second field, and reaches the maximum after completion of the write operation.

Figure 15B:
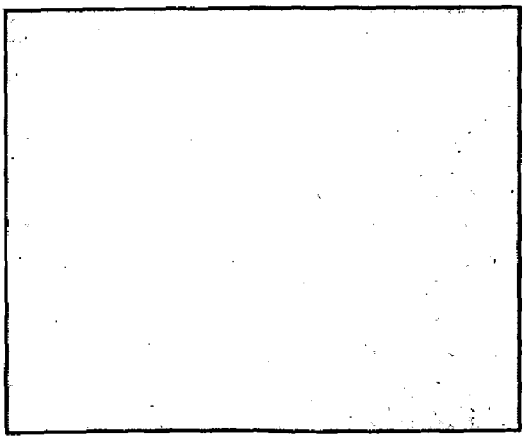
FIG. 15B shows distributions in the forth and fifth embodiments.

FIG. 15B shows a brightness distribution actually observed and averaged in frame time in a liquid crystal display panel according to the present embodiment. The method for driving of the present embodiment mitigates variation in brightness which is observed in the conventional method for driving of FIG. 9B and the third embodiments of FIG. 15A. Consequently, stripes having different brightnesses observed in the second and third embodiments are not generated. Further, unlike in the first embodiment shown in FIG. 11B in which no variation is generated in brightness within a screen, the degree of observed flickers can be decreased. That is, in the present embodiment, since flicker is generated at different timings between the odd lines and the even lines of the interlace drive, the degree of observed flicker decreases due to averaging between the lines. Further, since there exists no period during which the entire screen becomes black, the degree of flicker decreases further. Moreover, since the effective frequency is higher than that in the first embodiment of FIG. 10, the difference between the length of the display period 102 in the first field and that in the second field decreases to about half that in the first embodiment, and the write operation can be performed twice in each frame. As a result, the difference between the length of the display period 102 in the first field and that in the second field becomes very small, and data signals of opposite polarities can be written for the first and second fields. Therefore, electrical asymmetry is hardly produced, and the possibility of occurrence of image sticking is small.

Fifth Embodiment

Figure 17:
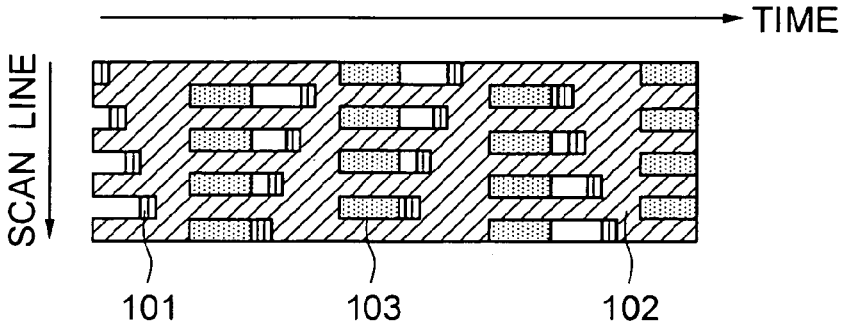
FIG. 17 is charts showing the structure and operation of the fifth embodiment of the present invention, wherein FIG. 17(*a*) shows a time chart for each scan line, FIG. 17(*b*) shows the waveform of a voltage applied for the first scan line and variation in transmittance at that time, and FIG. 17(*c*) shows the waveform of a voltage applied for the eighth scan line and variation in transmittance at that time.
Figure 17:
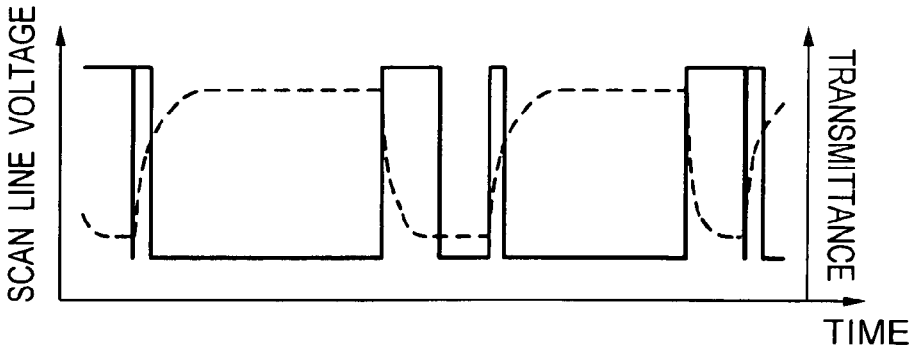
Figure 17:
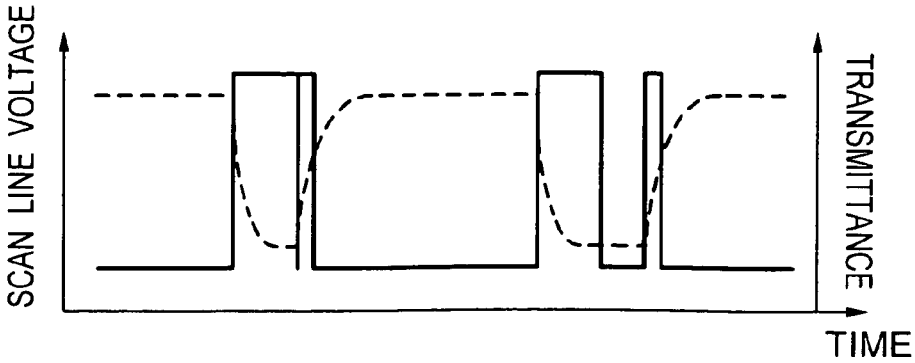

FIGS. 17(*a*)–17(*c*) are time charts that show a fifth embodiment of the present invention in the same manner as in FIGS. 10(*a*)–10(*c*). In the present embodiment, bi-directional scanning is performed in combination with interlace drive as in the second to fourth embodiments. However, in the present embodiment, bi-directional interlace drive is performed within each of the first and second fields, and the scanning direction in the second field is made opposite to that in the first field. That is, for odd scan lines, a write period 101 is provided in a first half of the first field such that these scan lines are successively scanned from the top, followed by a display period 102, and a reset period 103 is provided at the end of the first field. Subsequently, a write period 101 is provided in a first half of the second field such that these scan lines are successively scanned from the bottom, followed by a display period 102, and a reset period 103 is provided at the end of the second field. By contrast, for even scan lines, a reset period 103 is provided at the end of the first half of the first field, and a write period 101 is provided in the second half of the first field such that these scan lines are successively scanned from the bottom, followed by a display period 102. Subsequently, a reset period 103 is provided at the end of the first half of the second field, and a write period 101 is provided in the second half of the second field such that these scan lines are successively scanned from the top, followed by a display period 102. Another reset period is provided at the end of the first half of the first field of the next frame (unillustrated).

As shown in FIG. 17(*b*), with respect to the first scan line, a write signal is applied to the liquid crystal at the beginning of the first field, a reset signal is applied to the liquid crystal at the end of the first field, a write signal is applied to the liquid crystal at a point slightly before the end of the second field, and a reset signal is applied to the liquid crystal at the end of the second field. Therefore, the transmittance starts to increase from the beginning of the first field, reaches the maximum after completion of the write operation, and reaches the minimum during the reset period at the end of the first field. The transmittance again starts to increase at a point slightly before the end of the first half of the second field, reaches the maximum after completion of the write operation, and reaches the minimum during the reset period at the end of the second field. As shown in FIG. 17(*c*), with respect to the eighth scan line, a reset signal is applied to the liquid crystal at the end of the first half of the first field, a write signal is applied to the liquid crystal at the beginning of the second half of the first field, a reset signal is applied to the liquid crystal at the end of the first half of the second field, and a write signal is applied to the liquid crystal at a point slightly before the end of the second half of the second field. Therefore, the transmittance reaches the minimum at the end of the first half of the first field, starts to increase at the beginning of the second half of the first field, and reaches the maximum after completion of the write operation. The transmittance again reaches the minimum at the end of the first half of the second field, starts to increase at the point slightly before the end of the second half of the second field, and reaches the maximum after completion of the write operation. The brightness distribution actually observed and averaged in frame time in a liquid crystal display panel of the present embodiment is the same as that shown in FIG. 15B for the fourth embodiment. Other features are the same as those of the fourth embodiment.

Sixth Embodiment

Figure 18:
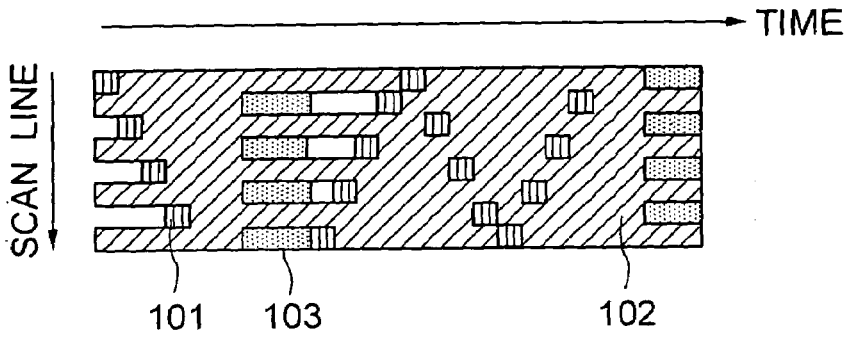
FIG. 18 is charts showing the structure and operation of sixth and seventh embodiments of the present invention, wherein FIG. 18(*a*) shows a time chart for each scan line in the sixth embodiment, FIG. 18(*b*) shows distribution of brightness within a panel surface averaged with respect to frame time, and FIG. 18(*c*) shows a time chart for each scan line in the seventh embodiment.
Figure 18:
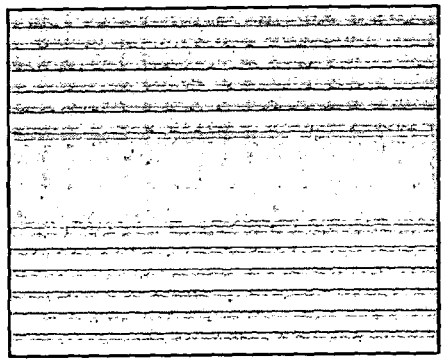
Figure 18:
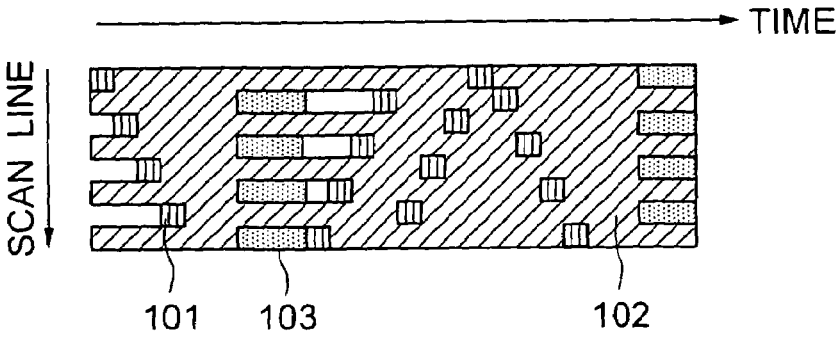

FIG. 18(*a*) is a time chart that shows a sixth embodiment of the present invention in the same manner as in FIG. 10(*a*). In the present embodiment, bi-directional scanning is performed in combination with interlace drive as in the second to fifth embodiments. However, the present embodiment employs the data signal voltage shown in FIG. 5 and differs from the previous embodiment in that two write period 101 and one reset period 103 are provided in each frame. That is, for odd scan lines, a write period 101 is provided in a first half of the first field such that these scan lines are successively scanned from the top, followed by a display period 102. Subsequently, a write period 101 is provided in a first half of the second field such that these scan lines are successively scanned from the top, followed by a display period 102, and a reset period 103 is provided at the end of the second field. By contrast, for even scan lines, a reset period 103 is provided at an intermediate point in the first field, and a write period 101 is provided in the second half of the first field such that these scan lines are successively scanned from the bottom, followed by a display period 102. Subsequently, a write period 101 is provided in the second half of the second field such that these scan lines are successively scanned from the bottom, followed by a display period 102. Another reset period is provided at an intermediate position in the first field of the next frame (unillustrated).

Figure 9A:
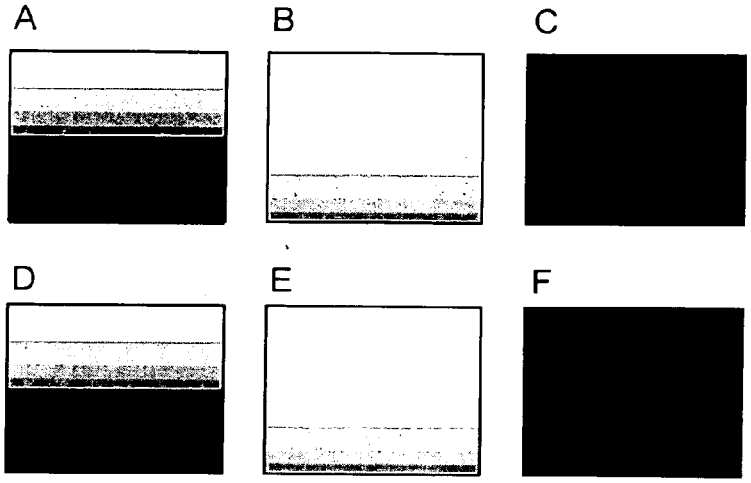
FIG. 9A PRIOR ART
FIG. 9A shows brightness distributions at times 1A–1F in FIG. 8(*a*)
Figure 9B:
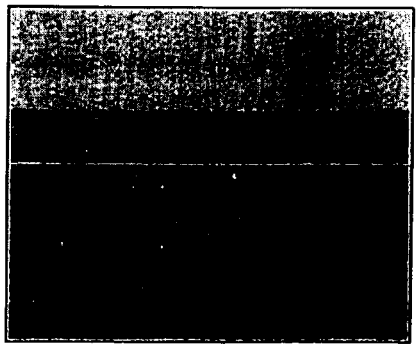
FIG. 9B PRIOR ART
FIG. 9B shows brightness distribution averaged within a frame time.

FIG. 18(*b*) shows a brightness distribution actually observed and averaged in frame time in the present embodiment. Although the method for driving of the present embodiment mitigates the variation in brightness distribution within the screen which is observed as shown in FIG. 9B when the conventional method for driving is employed, stripes having different brightnesses and corresponding to the scan lines are formed at the top and bottom portions of the screen. However, such stripes are hardly formed at the central portion of the screen. Since the pitch of the scan lines is very small in an actual screen, the brightnesses of the strips are averaged spatially, so that substantially uniform brightness is obtained over the entire screen. The brightness obtained in the present embodiment is considerably higher as compared with the conventional method for driving (FIG. 9B) and the first embodiment (FIG. 11B). Further, since the time between the reset period and the next write period is shorter than that in the second embodiment, higher brightness is obtained. Moreover, since flicker is generated at different timings between the odd lines and the even lines of the interlace drive, the degree of observed flicker decreases due to averaging between the lines. Further, since there exists no period during which the entire screen becomes black, the degree of flicker decreases further.

Seventh Embodiment

FIG. 18(*c*) is a time chart that shows a seventh embodiment of the present invention in the same manner as in FIG. 10(*a*). The present embodiment is almost the same as the sixth embodiment, but differs therefrom in terms of the scanning direction in the second field. Bi-directional scanning is performed in combination with interlace drive as in the second to fifth embodiments. That is, for odd scan lines, a write period 101 is provided in a first half of the first field such that these scan lines are successively scanned from the top, followed by a display period 102. Subsequently, a write period 101 is provided in a first half of the second field such that these scan lines are successively scanned from the bottom, followed by a display period 102, and a reset period 103 is provided at the end of the second field. By contrast, for even scan lines, a reset period 103 is provided at an intermediate point in the first field, and a write period 101 is provided in the second half of the first field such that these scan lines are successively scanned from the bottom, followed by a display period 102. Subsequently, a write period 101 is provided in the second half of the second field such that these scan lines are successively scanned from the top, followed by a display period 102. Another reset period 103 is provided at an intermediate position in the first field of the next frame (unillustrated). The time averaged brightness distribution is the same as that shown in FIG. 18(*b*) for the sixth Embodiment.

Eighth Embodiment

Figure 5:
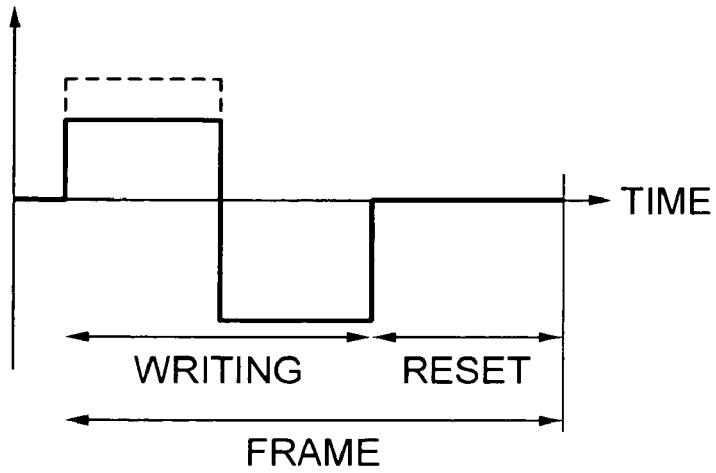
FIG. 5 PRIOR ART
FIG. 5 shows diagrams for describing the waveform of a data signal for prevention of a step response, wherein FIG. 5(*a*) shows the waveform of an applied voltage, and FIG. 5(*b*) shows variation in transmittance upon application of the voltage of FIG. 5(*a*).
Figure 5:
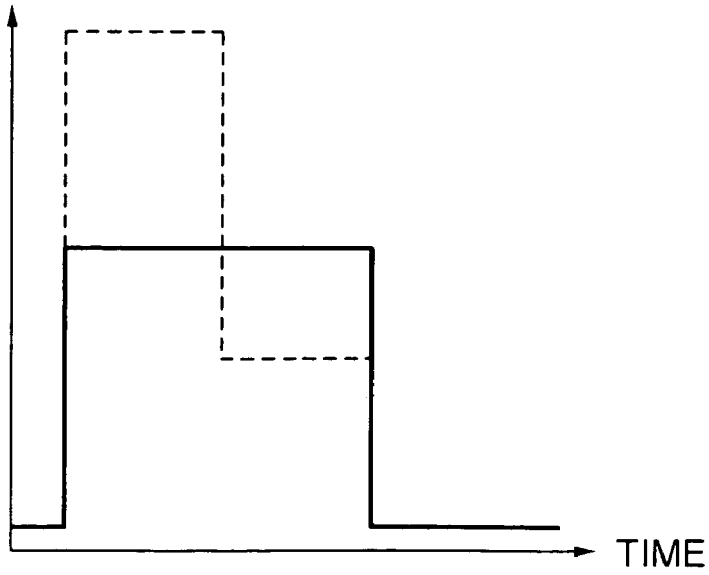
FIG. 5 PRIOR ART
Figure 6:
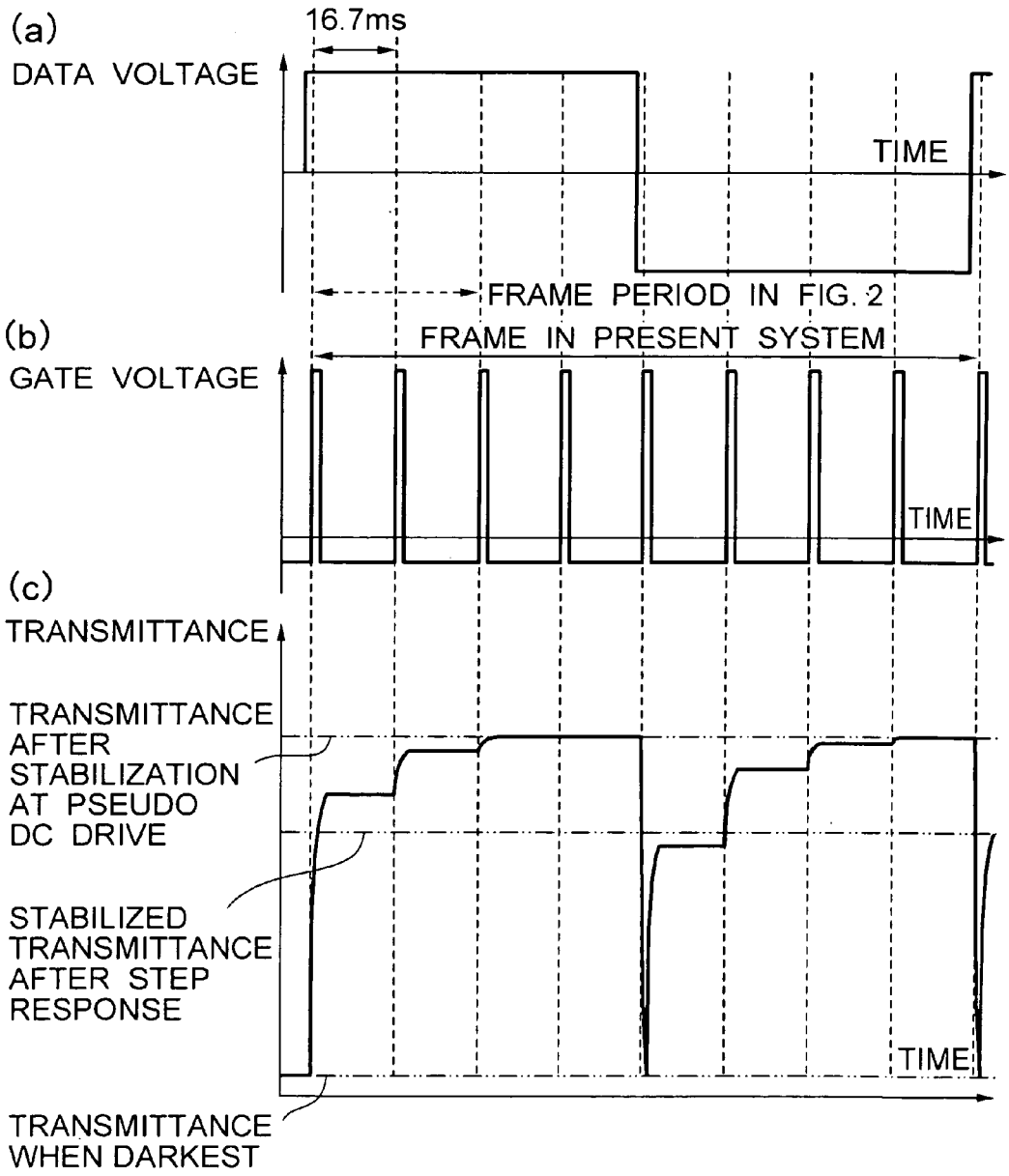
FIG. 6 PRIOR ART
FIG. 6 shows charts for describing the waveform of a data signal used in a conventional pseudo DC driving method, wherein FIG. 6(*a*) is the waveform of a voltage applied to a data line, FIG. 6(*b*) shows the waveform of a voltage applied to a gate line, and FIG. 6(*c*) shows variation in transmittance when the voltages of FIGS. 6(*a*) and 6(*b*) are applied to fast response liquid crystal.
Figure 7:
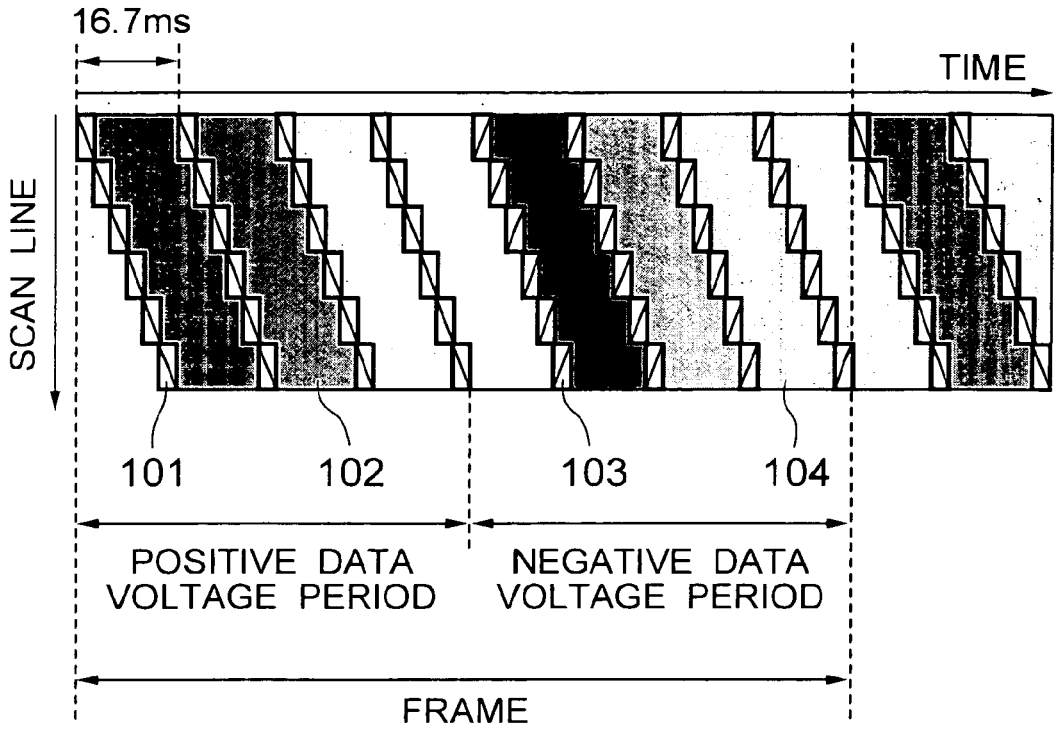
FIG. 7 PRIOR ART
FIG. 7 is a diagram showing the time chart for each scan line and the brightness of display for each scan line in the conventional pseudo DC driving method shown in FIG. 6.
Figure 8:
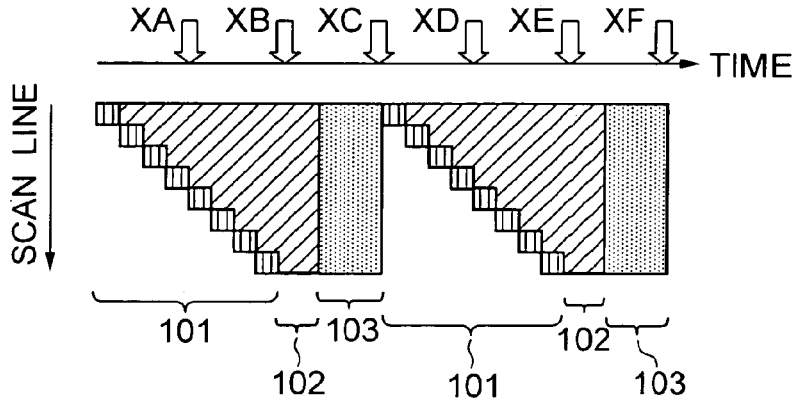
FIG. 8 PRIOR ART
FIG. 8 is charts showing a conventional method for driving, wherein FIG. 8(*a*) is a time chart for each scan line, FIG. 8(*b*) shows the waveform of a voltage applied for a first scan line and variation in transmittance at that time, and FIG. 8(*c*) shows the waveform of a voltage applied for an eighth scan line and variation in transmittance at that time.
Figure 8:
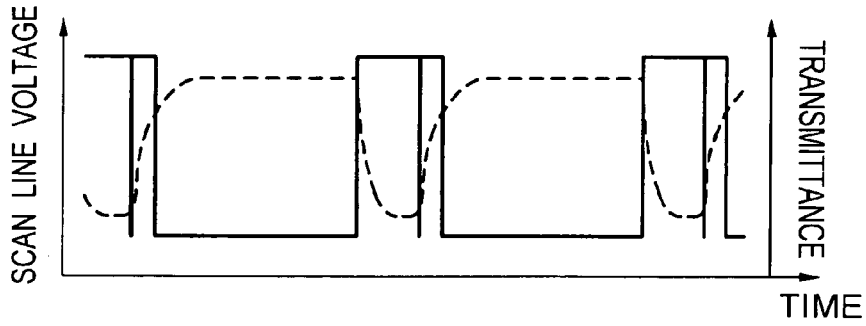
FIG. 8 PRIOR ART
Figure 8:
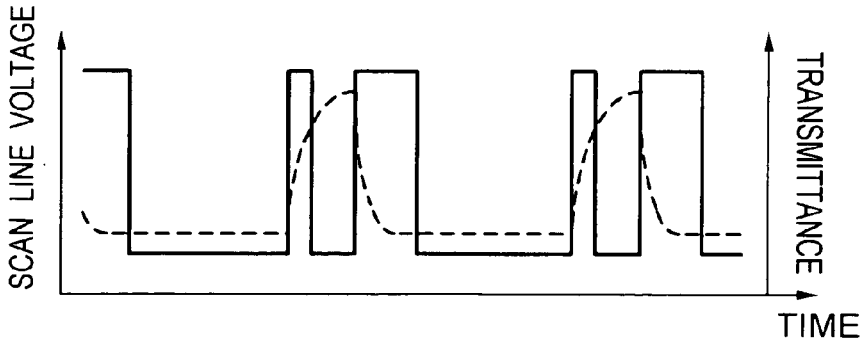
FIG. 8 PRIOR ART
Figure 19A:
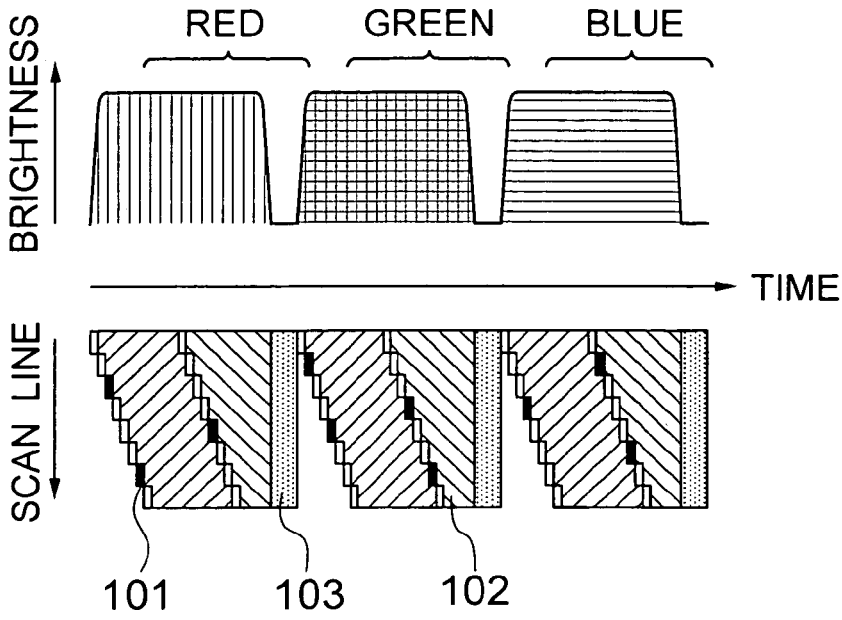
FIG. 19A is a time chart for each light-source and each scan line in the eighth embodiment.

FIG. 19A is a time chart showing an eighth embodiment of the present invention. The present embodiment premises the provision of field-sequential display. Therefore, in addition of the time chart of FIG. 10(*a*), FIG. 19A shows brightness radiated from a light source to a display panel as one vertical axis. The light source is scanned in turn of red, green, and blue, in this drawing. The color sequence may be changed freely together with a corresponding change in the sequence of data signals. The light from the light source does not enter the panel during the reset period, during which the color of the light is changed. Although the scanning is performed in the same timing as that in the case where the data signal voltage shown in FIG. 5 is used, three reset periods 103 are provided in each frame, because of the field sequential display. Two write periods 101 are provided within each scanning period for each color, and positive and negative data signals are distributed and applied to each write period by every polarity. A reset period 103 is provided after the two write periods. The period set including two write periods and one reset period is repeated three times synchronously with the change of color. As a result of the change of color and the scanning of scan lines, information for the respective colors is displayed within one frame, so that color can be displayed at pixel level. Since the number of the reset periods becomes half that in the case in which the conventional method for driving shown in FIG. 8 is repeated three times to effect field sequential display, brighter display is enabled. The observed brightness distribution becomes the same as that shown in FIG. 9B, in which the lower portion of the screen is displayed more darkly.

Ninth Embodiment

Figure 19B:
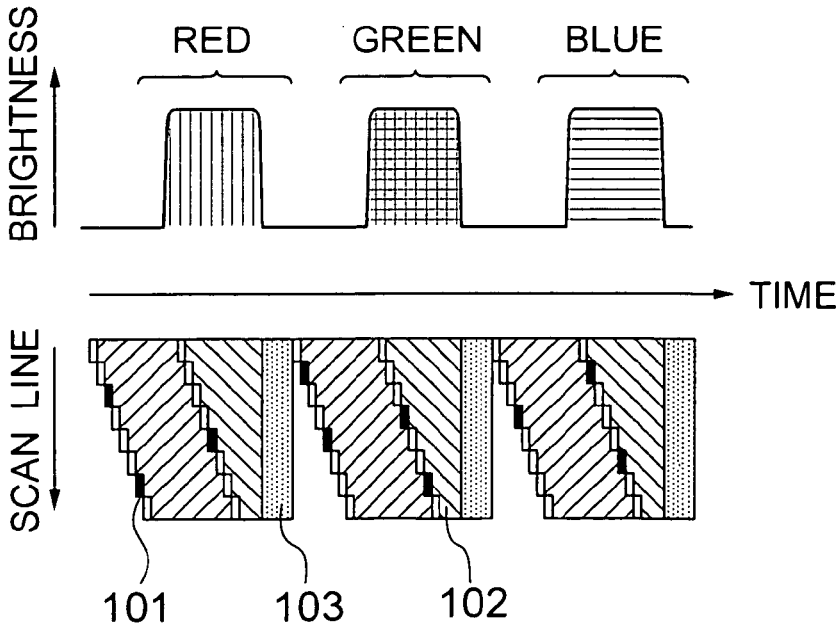
FIG. 19B is a time chart for each light-source and each scan line in the ninth embodiment.
Figure 20:
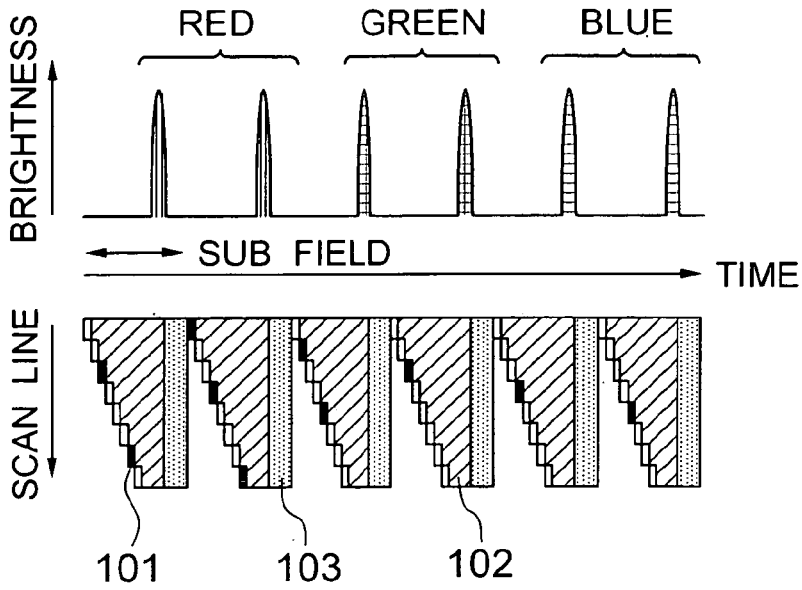
FIG.20 PRIOR ART
FIG. 20 is a time chart for each light-source and each scan line showing a method for driving which is suitable for a conventional field-sequential liquid crystal display apparatus and which eliminates brightness variation in a panel surface, as well as the constitution of the light source brightness.

FIG. 19B is a time chart showing a ninth embodiment of the present invention in the same manner as in FIG. 19A. As in the eighth embodiment, the color of light is scanned among red, green, and blue, in this sequence. The color sequence may be changed freely together with a corresponding change in the sequence of data signals. The present embodiment differs from the eighth embodiment in that light from the light source does not enter the liquid crystal not only during the reset period but also during a period including the first write period after the reset period and a period required for stabilization of display, and such an extended period is used for switching the color among three colors. That is, after completion of a transition period in which the entire screen from the top portion to the lower portion of the panel is changed from the reset state to a new display state, the light source radiates light to the liquid crystal panel in order to allow an observer to view the displayed color image. This method eliminates variation in brightness within the screen observed in the eighth embodiment, so that uniform brightness is obtained over the entire screen. FIG. 20 is a time chart showing time allotment for light-source colors and time allotment for each scan line in a method for driving for eliminating variation in brightness within a panel surface driven by a conventional field-sequential liquid crystal display apparatus. In the conventional method for driving, light is radiated from the light source to the liquid crystal panel when the reset operation is completed and display of a written image becomes stable. Therefore, the period of time during which the light source is turned on is very short. By contrast, in the present embodiment, since the period during which the light source is in an on state is long, the brightness over the entire screen becomes higher.

Tenth Embodiment

Figure 21:
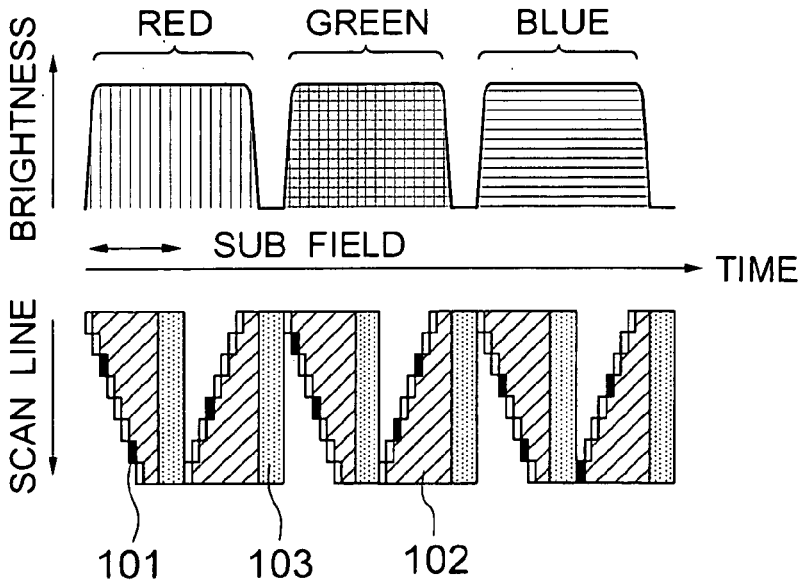
FIG. 21 is a time chart for each light-source and each scan line, showing the structure and operation of a tenth embodiment of the present invention.

FIG. 21 is a time chart showing a tenth embodiment of the present invention in the same manner as in FIG. 18(*a*). The light source is scanned among red, green, and blue, in this sequence. The color sequence may be changed freely together with a corresponding change in the sequence of data signals. Although the scanning is performed in the same timing as that of the bi-direction scanning of the first embodiment as shown in FIG. 10, three reset periods 103 are provided in each frame because of the field sequential display. Two write periods 101 are provided within each scanning period for each color, and positive and negative data signals are distributed and applied to each write period by every polarity. The first and second write periods 101 correspond to scanning from the top and scanning from the bottom of the bi-directional scanning. In FIG. 21, when the color of light is red, for example, the scanning from the top is first performed, followed by a reset period, the scanning from the bottom, and another reset period, in this sequence. In this manner, the period set including two write periods and two reset periods is repeated three times synchronously with the change of color. Herein, a period including one write period and one reset period is called a "sub field." First and second sub fields are present for each color, and a field set including these sub fields is repeated three times to constitute one frame. The light source is turned on at the beginning of the first sub field and is turned off immediately before the reset period of the second sub field. During the reset period, the color is changed. As a result of the scanning of color and the scanning of scan lines, information for the respective colors is displayed within one frame, so that color display can be displayed at the pixel level. Since the present embodiment employs bi-directional scanning as in the first embodiment, adjustment of the on-period of the light source as in the ninth embodiment becomes unnecessary, and the variation in brightness within the screen is eliminated. Further, since the period during which the light source is in an on state is longer than that in the conventional method shown in FIG. 20, the brightness becomes higher than that obtained in the conventional method. Whereas the light source must be turned on and off each sub field in the conventional method shown in FIG. 20, such on-and-off operation is unnecessary in the present embodiment.

Eleventh Embodiment

Figure 22:
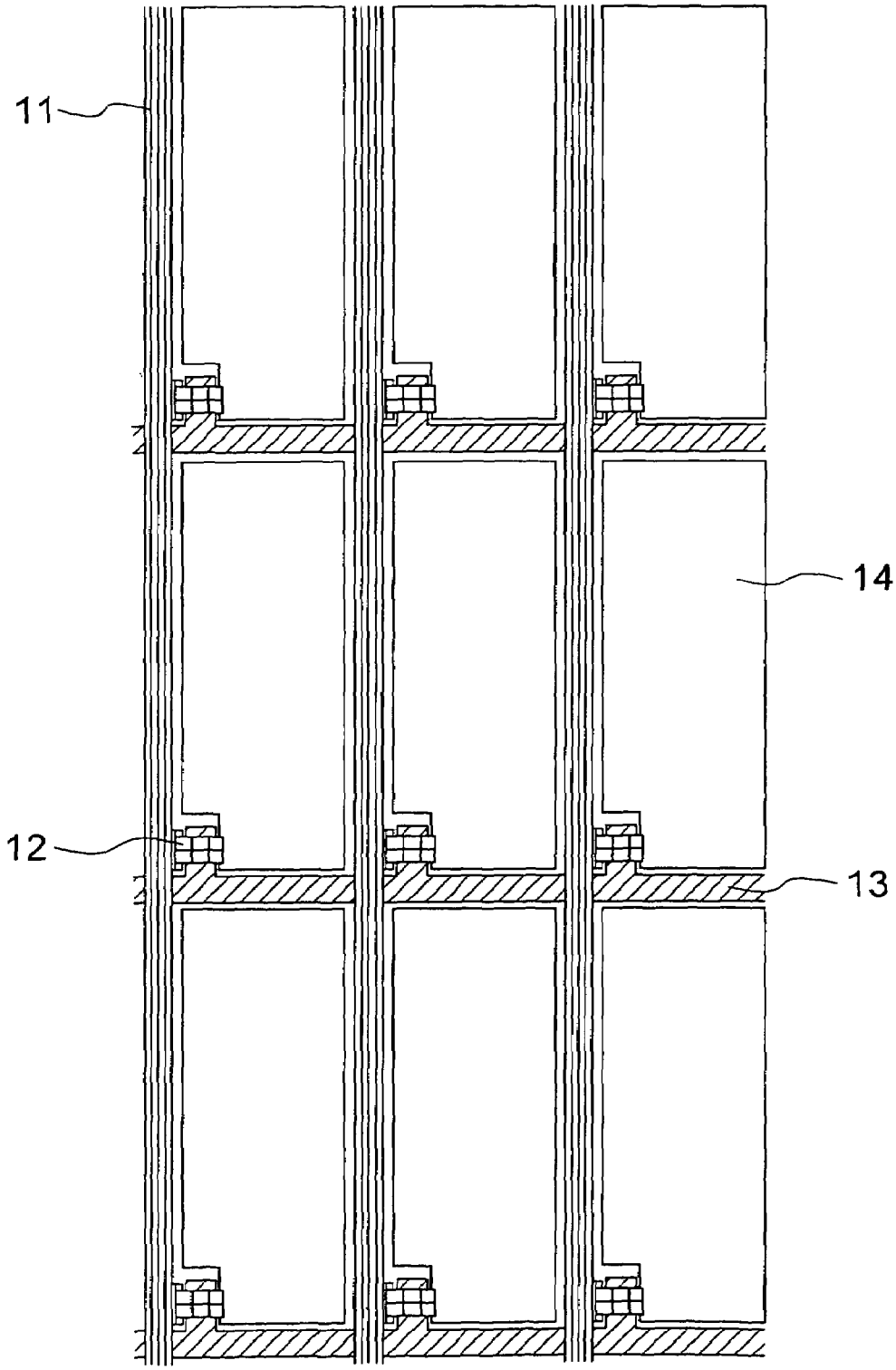
FIG. 22 is a plan view of an array of thin-film transistors of a liquid crystal display apparatus according to an eleventh embodiment of the present invention.
Figure 23:
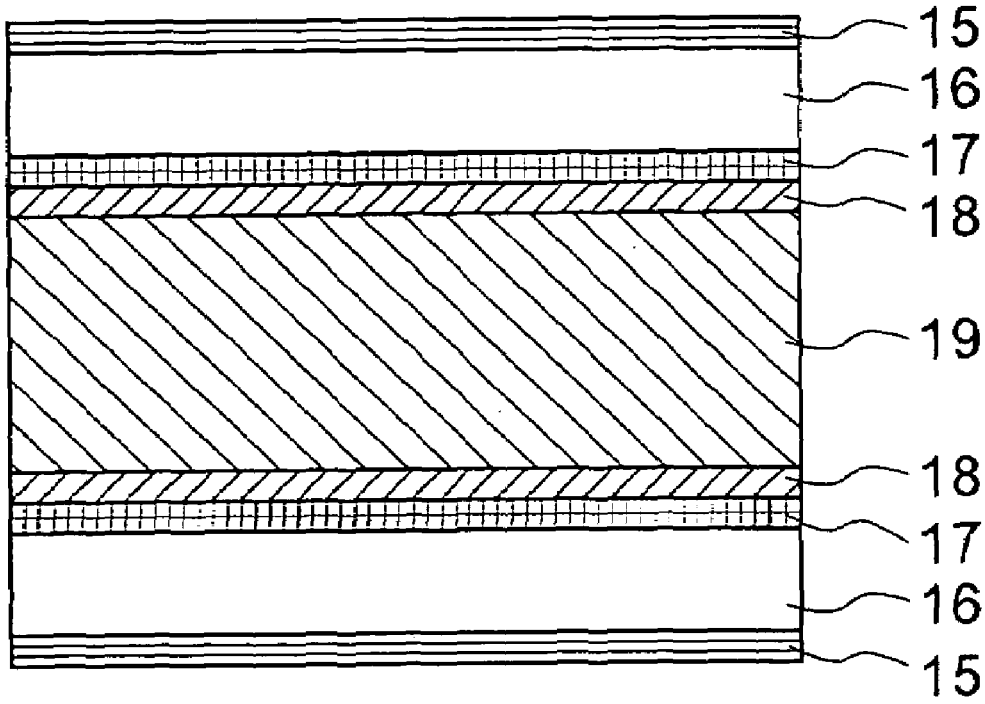
FIG. 23 is a side view of the liquid crystal display apparatus according to the eleventh embodiment of the present invention.

An eleventh embodiment of the present invention is directed to a liquid crystal display apparatus that employs any one of the methods for driving according to the first through seventh embodiments. FIG. 22 is a plan view of a liquid crystal display apparatus according to the present embodiment, showing an array of TFTs (thin-film transistors 12) on one substrate. The substrate of the present embodiment includes a TFT substrate and an opposite substrate. As shown in FIG. 22, the TFT substrate has a plurality of gate bus lines 13, a plurality of drain bus lines 11, and an array composed of a plurality of TFTs 12. At least one pixel electrode 14 is provided for each pixel. FIG. 23 is a schematic view showing a section of the liquid crystal display apparatus of the present embodiment. An electrode 17 is formed on each of two support substrates 16, and an orientation film 18 for orientating liquid crystal is formed thereon. Liquid crystal 19 is held between the support substrates 16, and a pair of polarization plates 15 are provided on the outer surfaces of the support substrates 16.

The operation of the present embodiment is as follows. A data signal having a waveform corresponding to a selected method for driving is applied to each drain bus line 11 at a predetermined frequency. Further, a signal having a waveform shown in the respective embodiments and capable of turning on the TFT 12 is applied to each gate bus line 13 when the gate bus line 13 is selected. Thus, the voltage on the drain bus line 11 is applied to the liquid crystal via the display electrode. The applied voltage is held in the liquid crystal until the gate bus line 13 is selected again. This enables the operation of holding a display if the liquid crystal has no ability of storing. For reset operation, a predetermined reset signal is applied to the drain bus line 11, and a voltage for turning on the TFT 12 is applied to the gate bus line 13 at the timing shown in the respective embodiments. Through the above operation, the liquid crystal display apparatus is driven by the method for driving according to any one of the first through seventh embodiments of the present invention.

Twelfth Embodiment

A liquid crystal display apparatus according to a twelfth embodiment of the present invention has a structure similar to that shown in FIG. 23 and is driven by any one of the methods for driving of the eighth to tenth embodiments. An electrode 17 is formed on each of two support substrates 16, and an orientation film 18 for orientating liquid crystal is formed thereon. Liquid crystal 19 is held between the support substrates 16, and a pair of polarization plates 15 are provided on the outer surfaces of the support substrates 16. Further, an unillustrated light source for field sequential display is provided adjacent to one of the polarization plates 15. Thus, there is obtained a liquid crystal display apparatus that is driven by the method for driving according to any one of the eighth through tenth embodiments of the present invention.

Thirteenth Embodiment

A liquid crystal display apparatus according to the thirteenth embodiment of the present invention has an improvement over the eleventh embodiment or the twelfth embodiment. The liquid crystal display apparatus of the present embodiment has a structure for canceling out or generally mitigating the viewing angle dependency of the liquid crystal and the variation in brightness within a screen caused by the method for driving. Due to this structure, the viewing angle dependency of the liquid crystal and the variation in brightness within a screen caused by the method for driving is mitigated, so that the liquid crystal display apparatus of the present embodiment provides excellent display.

Next, there will be described specific examples of the liquid crystal display apparatus to which the above-mentioned embodiments of the first invention are applied.

Example 1

Chromium (Cr) was spattered to form 480 gate bus lines and 640 drain bus lines each having a width of 10 μm. A gate insulating film was formed by use of silicon nitride ($SiN_x$). Each pixel had a length of 330 μm and a width of 110 μm. TFTs (thin-film transistors) were formed by use of amorphous silicon, and transparent electrodes serving as pixel electrodes were formed of indium tin oxide (ITO) through spattering. A glass substrate on which TFTs had been formed in an array was used as a first substrate. A second substrate to be disposed opposite to the first substrate was formed as follows. A light shielding film of chromium was formed on a glass plate, and transparent electrodes (common electrodes) of ITO were formed thereon. Subsequently, a color filter was formed in a matrix shape by use of a staining technique, and a protective layer of silica was formed thereon. Subsequently, soluble polyimide was printed by means of a printing method, and the substrate was then baked at 180° C. in order to remove the solvent. Through use of a rubbing apparatus in which rayon buff cloth is wound around a roller having a diameter of 50 mm, the polyimide film was rubbed such that parallel rubbing was performed twice under the following conditions: roller rotational speed of 600 rpm, stage feed speed of 40 mm/sec, and press amount of 0.7 mm. The thickness of the orientation film measured through use of a contact-type step meter was about 500 angstroms, and the pre-tilt angle measured by a crystal rotation method was 7 degrees. Micro pearls having a diameter of about 9.5 μm and serving as spherical spacers were dispersed on one of the glass substrates, and an ultraviolet-hardening-type seal material in which cylindrical rod spacers made of glass and having a diameter of about 9.5 μm had been dispersed was applied to the other glass plate. These plates were disposed such that they faced each other and their directions of rubbing became parallel to each other. Subsequently, ultraviolet rays were radiated in a non-contacting manner in order to cure the seal material, thereby completing a panel having a gap of 9.5 μm, into which nematic liquid crystal was injected. In the present embodiment, a compensation plate was added in order to operate the panel in an OCB (optically compensated bi-refligence) display mode described in SID 94, digest, pp. 927–930. A driver was attached to the thus-fabricated liquid crystal panel in order to complete the liquid crystal display apparatus.

The method for driving of the first embodiment was applied to the above-described liquid crystal display apparatus. Specifically, the length of the reset period 103 was set to 5 msec, the length of the write period for each scan line was set to 15 μsec, and the length of each field was set to 16.7 msec. As result, a display period of about 4.5 msec was secured in one field, even for the last-scanned scan line. Further, a display period of about 16 msec was obtained when the two display periods of the bi-directional scanning were added. Although the rising response speed of the liquid crystal depends on the applied voltage, the response is completed within a few to 5 msec, i.e., after writing operation. The liquid crystal panel provided a wide view angle and has no dependency on the viewing angle. When the liquid crystal display apparatus was observed, no variation in brightness was observed within the panel, and therefore, a wide view angle was obtained by taking advantage of the characteristics of the liquid crystal display mode providing the wide view angle.

Example 2

A TFT substrate and a color filter substrate were fabricated in the same manner as in Example 1. Subsequently, polyamic acid was applied thereon by a spin coat method, and these substrates were baked at 200° C. in order to form polyimide film through imidation. Through use of a rubbing apparatus in which Nylon buff cloth is wound around a roller having a diameter of 50 mm, the polyimide film was rubbed such that cross rubbing was performed twice under the following conditions: roller rotational speed of 600 rpm, stage feed speed of 40 mm/sec, press amount of 0.7 mm, and rubbing cross angle of 10°. The thickness of the orientation film measured through use of a contact-type step meter was about 500 angstroms, and the pre-tilt angle measured by a crystal rotation method was 1.5 degrees. Micro pearls having a diameter of about 2 μm and serving as spherical spacers were dispersed on one of a pair of glass substrates, and a thermosetting seal material in which cylindrical rod spacers made of glass and having a diameter of about 2 μm had been dispersed was applied to the other glass plate. These plates were disposed such that they faced each other and their directions of rubbing intersected each other at angle of 10°. Subsequently, the seal material was hardened through heat treatment, thereby completing a panel having a gap of 2 μm. Antiferroelectric liquid crystal performing V-shaped switching disclosed in Asia Display 95, pp 61–64 was injected in an isotropic phase (Iso) state into the panel at 85° C. under vacuum. While the temperature was maintained at 85° C., a rectangular wave having an amplitude of ÷10 V and a frequency of 3 kHz was applied to the entire surface of the panel through use of an arbitrary waveform generator and a high output amplifier in order to apply a field to the liquid crystal. In this state, the liquid crystal panel was gradually cooled to room temperature at a rate of 0.1° C./min. A driver was attached to the thus-fabricated liquid crystal panel in order to complete the liquid crystal display apparatus.

The method for driving of the fifth embodiment was applied to the above-described liquid crystal display apparatus. Specifically, the length of the reset period 103 was set to 1 msec, the length of the write period for each scan line was set to 10 μsec, the length of each field was set to 16.7 msec, and the length of each frame period was set to 33.4 msec. As result, a display period of about 10 msec was secured in one field, even for the last-scanned scan line. Further, a display period of about 25 msec was obtained when the two display periods in the bi-directional scanning were added. Although the rising response speed of the liquid crystal depends on the applied voltage, the response is completed within a few hundreds μsec, i.e., after writing operation. The liquid crystal panel provided a wide view angle and has no dependency on the viewing angle. When the liquid crystal display apparatus was observed, no variation in brightness was observed within the panel, and therefore, a wide view angle was obtained by taking advantage of the characteristics of the liquid crystal display mode proving the wide view angle.

Example 3

The same liquid crystal panel as that used in Example 2 was used. A driver and a high-speed swichable back light were combined with the liquid crystal panel to fabricate a field-sequential liquid crystal display apparatus.

The drive of the liquid crystal display apparatus and the scanning of brightness of a light source were performed in the manner of the tenth embodiment. Specifically, the length of the reset period 103 was set to 1 msec, the length of the write period for each scan line was set to 5 μsec, and the length of each frame period was set to 33.4 msec. As result, a display period of about 6.5 msec was secured for each color. Further, no variation in brightness was observed within the panel.

Comparative Example 1

The same field-sequential liquid crystal display mode as that used in Example 3 was used. The conventional method for driving (FIG. 20) of the liquid crystal display apparatus and field-sequential liquid crystal display apparatus using the scanning of brightness of a light source were employed. Although no variation in brightness was observed within the panel as in Example 3, the display period for each color was about 4 msec, and the panel brightness was about half that obtained in Example 3.

Example 4

A micro display was fabricated as a reflection type projector. The micro display had a similar structure as that of a micro display produced by Displaytech Corp. described at the beginning of Advanced Imaging, January, 1997. Specifically, MOS FETs were formed on a silicon wafer in accordance with a 0.8 μm rule in order to fabricate a DRAM. The die size was ½ inch, the pixel pitch was 10 μm, and the capacity of the DRAM was 1M bits. The aperture ratio of the pixel was 90% or higher. Further, the surface of the fabricated DRAM was made flat by use of a chemical mechanical polishing technique. A cover glass for microscope observation was used as an opposite substrate. A portion including a drive circuit was cut from a silicon wafer, and orientation film formed of soluble polyimide was printed. Subsequently, the substrate was baked at 170° C. in order to remove the solvent. Through use of a rubbing apparatus in which Nylon buff cloth is wound around a roller having a diameter of 50 mm, the polyimide film was rubbed twice under the following conditions: roller rotational speed of 600 rpm, stage feed speed of 40 mm/sec, and press amount of 0.7 mm. The thickness of the orientation film measured through use of a contact-type step meter was about 500 angstroms, and the pre-tilt angle measured by a crystal rotation method was 1.5 degrees. A light-curing-type seal material in which cylindrical rod spacers made of glass and having a diameter of about 2 μm had been dispersed was applied to each of the glass plates. These plates were disposed such that they faced each other, and ultraviolet rays were radiated in a non-contacting manner in order to cure the seal material, thereby completing a panel having a gap of 2 μm. Subsequently, antiferroelectric liquid crystal composition performing V-shaped switching disclosed in Asia Display 95, pp 61–64 was injected in an isotropic phase (Iso) state into the panel at 85° C. under vacuum. While the temperature was maintained at 85° C., a rectangular wave having an amplitude of ±10 V and a frequency of 3 kHz was applied to the entire surface of the panel through use of an arbitrary waveform generator and a high output amplifier. In this state, the liquid crystal panel was gradually cooled to room temperature at a rate of 0.1° C./min. while applying an electric field. Further, three light emitting diodes of three colors, a collimate lens for obtaining parallel light, a polarization conversion element, and a projection lens were combined to complete a reflection type field-sequential projector.

This liquid crystal display apparatus was driven by the method for driving of the ninth embodiment. As a result, excellent display in which no variation in brightness was obtained.

Fifth Embodiment

A TFT substrate and a color filter substrate were fabricated in the same manner as in Example 1. Subsequently, film of soluble polyimide was printed, and the substrate was baked at 180° C. in order to remove the solvent. Through use of a rubbing apparatus in which rayon buff cloth is wound around a roller having a diameter of 50 mm, the polyimide film was rubbed such that 90° rubbing was performed twice under the following conditions: roller rotational speed of 600 rpm, stage feed speed of 40 mm/sec, press amount of 0.7 mm, and rubbing cross angle of 90°. The thickness of the orientation film measured through use of a contact-type step meter was about 500 angstroms, and the pre-tilt angle measured by a crystal rotation method was 3 degrees. Micro pearls having a diameter of about 5.5 μm and serving as spherical spacers were dispersed on one of a pair of glass substrates, and a light-curing-type seal material in which cylindrical rod spacers made of glass and having a diameter of about 5.5 μm had been dispersed was applied to the other glass plate. These plates were disposed such that they faced each other and their directions of rubbing intersected each other at angle of 90°. Subsequently, ultraviolet rays were radiated in a non-contacting manner in order to cure the seal material, thereby completing a panel having a gap of 5.5 μm, into which nematic liquid crystal was injected. In the present embodiment, a TN-type liquid crystal panel was fabricated. A driver was attached to the thus-fabricated liquid crystal panel in order to complete the liquid crystal display apparatus.

This liquid crystal display apparatus was driven by the conventional method for driving shown in FIG. 8. However, the orientation of the TN-type liquid crystal panel having a viewing angle dependency in the vertical direction was adjusted such that a higher brightness was obtained when observed from the upper side and a lower brightness was obtained when observed from the lower side of the panel. As a result, when the panel was observed from the front, variation in brightness in the screen caused by the method for driving and the viewing angle dependency were canceled out each other, so that display better than that of a conventional panel was obtained.

Then, the present invention will be described in further detail by the description of embodiments and examples of the second and third invention with reference to the accompanying drawings.

Fourteenth Embodiment

Figure 24:
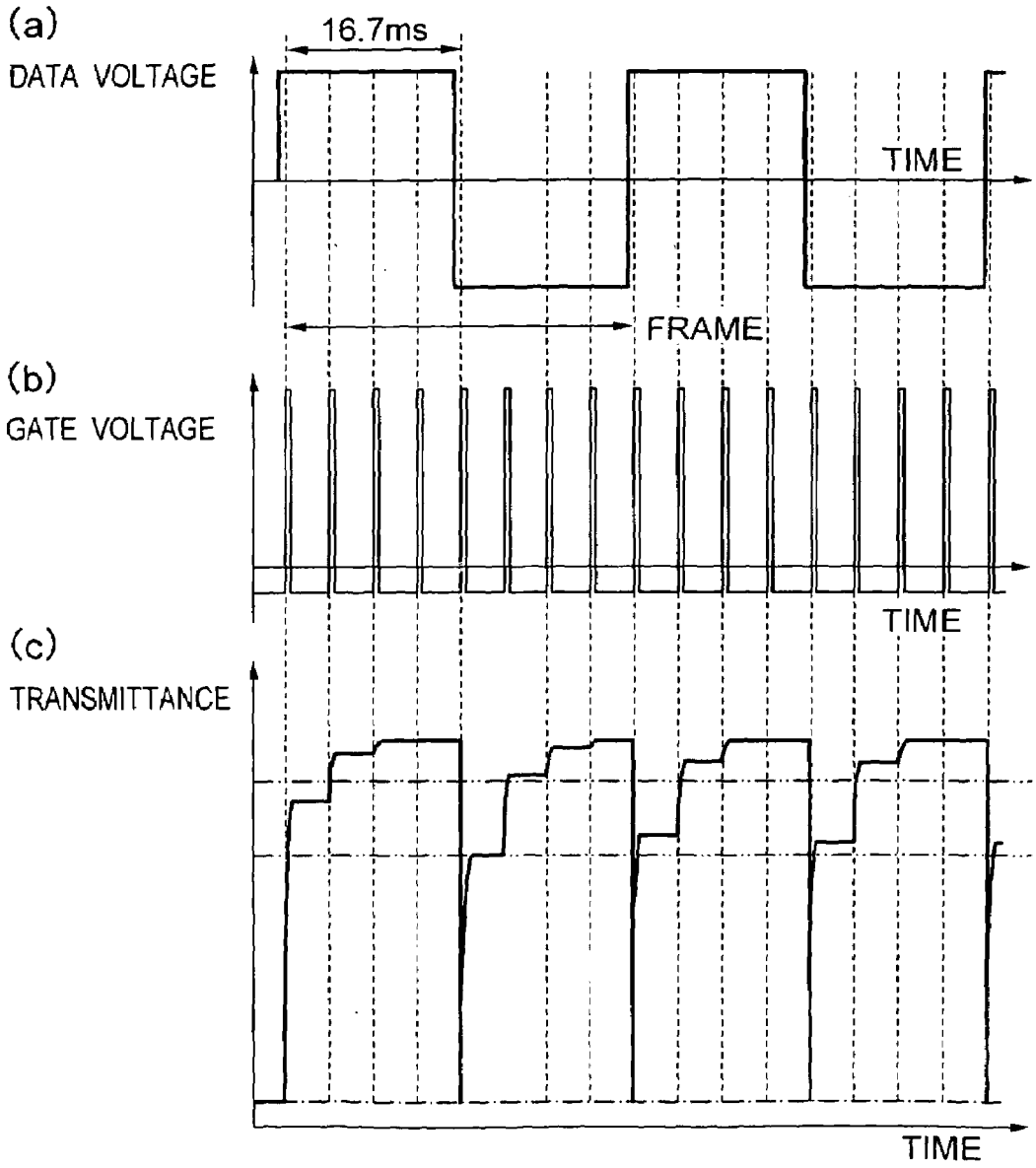
FIG. 24 is waveform charts for describing the structure and operation of a fourteenth embodiment, wherein FIG. 24(*a*) is the waveform of a voltage applied to a data line, FIG. 24(*b*) shows the waveform of a voltage applied to a gate line, and FIG. 24(*c*) shows variation in transmittance when the voltages of FIGS. 24(*a*) and 24(*b*) are applied to fast response liquid crystal.

The present embodiment is an example of a first method for driving a liquid crystal display element according to the present invention. FIG. 24(*a*) shows the waveform of a voltage applied to a data line, FIG. 24(*b*) shows the waveform of a voltage applied to a gate line, and FIG. 24(*c*) shows variation in transmittance when the voltages of FIGS. 24(*a*) and 24(*b*) are applied to fast response liquid crystal.

Figure 2:
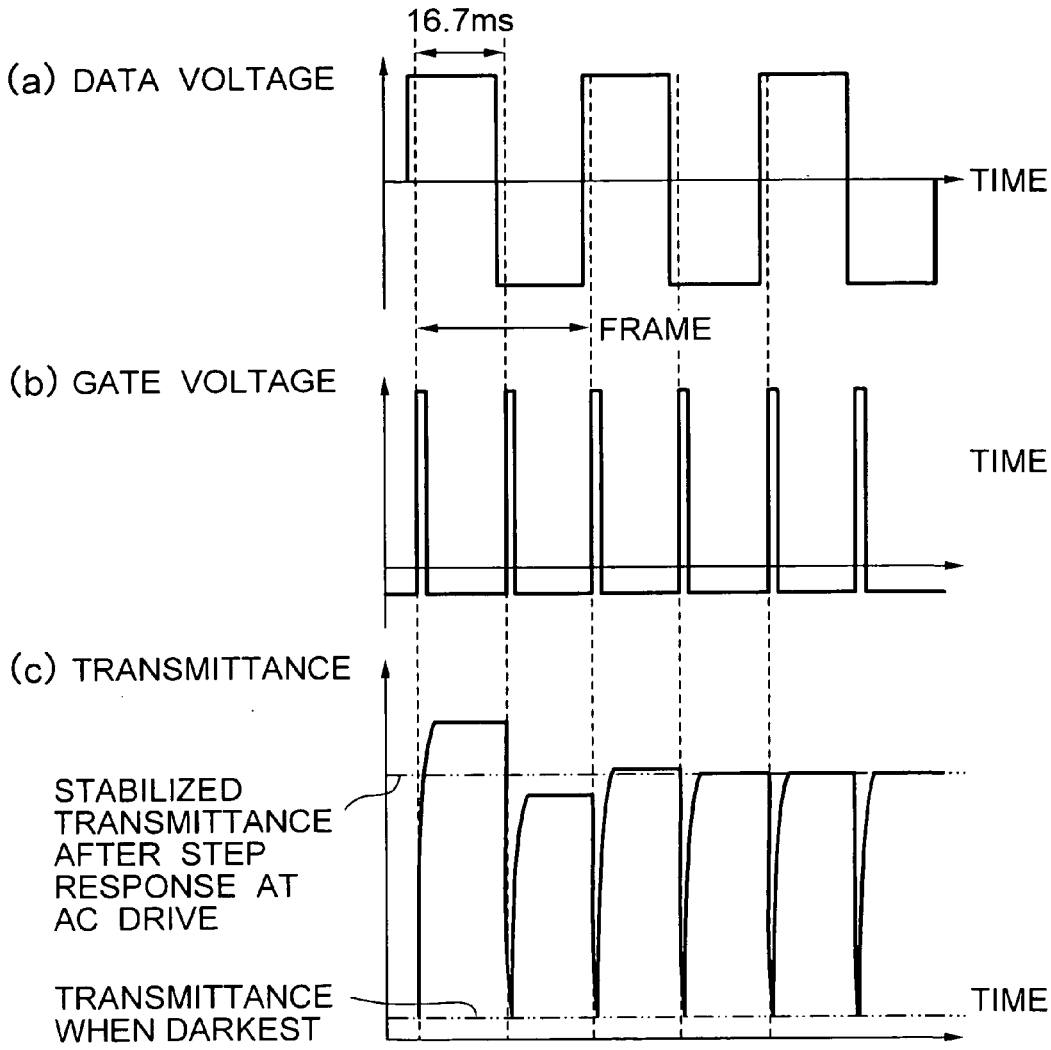
FIG. 2 PRIOR ART
FIG. 2 shows charts for describing the waveform of a data signal used in a conventional AC driving method, wherein FIG. 2(*a*) is the waveform of a voltage applied to a data line, FIG. 2(*b*) shows the waveform of a voltage applied to a gate line, and FIG. 2(*c*) shows variation in transmittance when the voltages of FIGS. 2(*a*) and 2(*b*) are applied to fast response liquid crystal.
Figure 3:
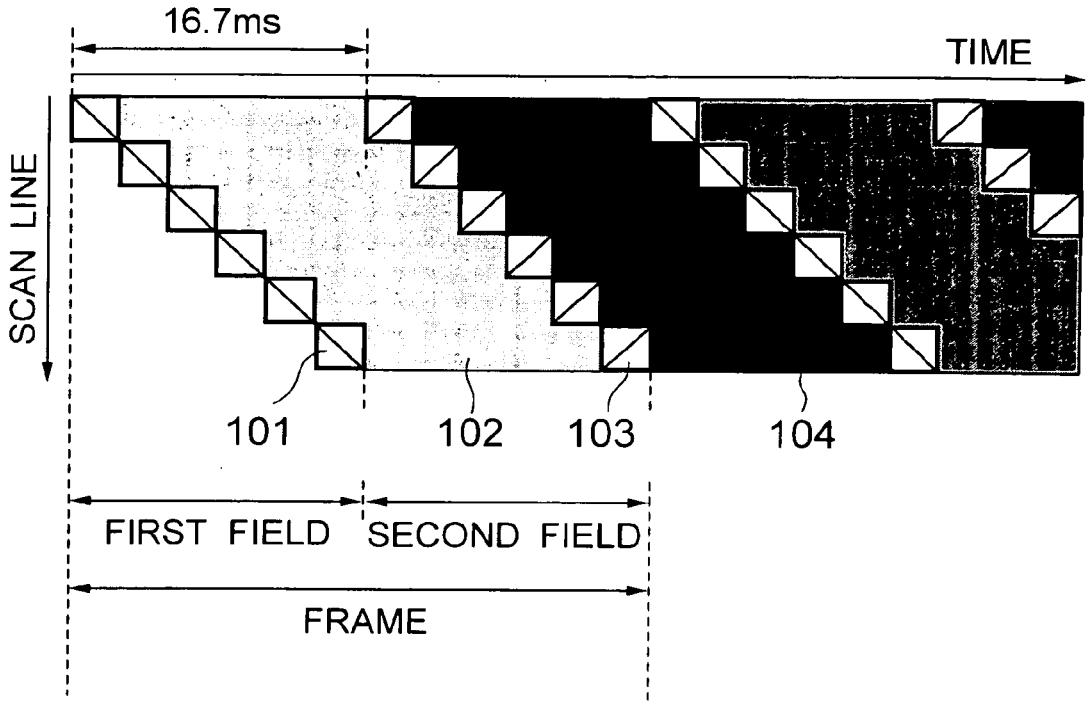
FIG. 3 PRIOR ART
FIG. 3 is a diagram showing the time chart for each scan line and the brightness of display for each scan line in the conventional AC driving method shown in FIG. 2.
Figure 4:
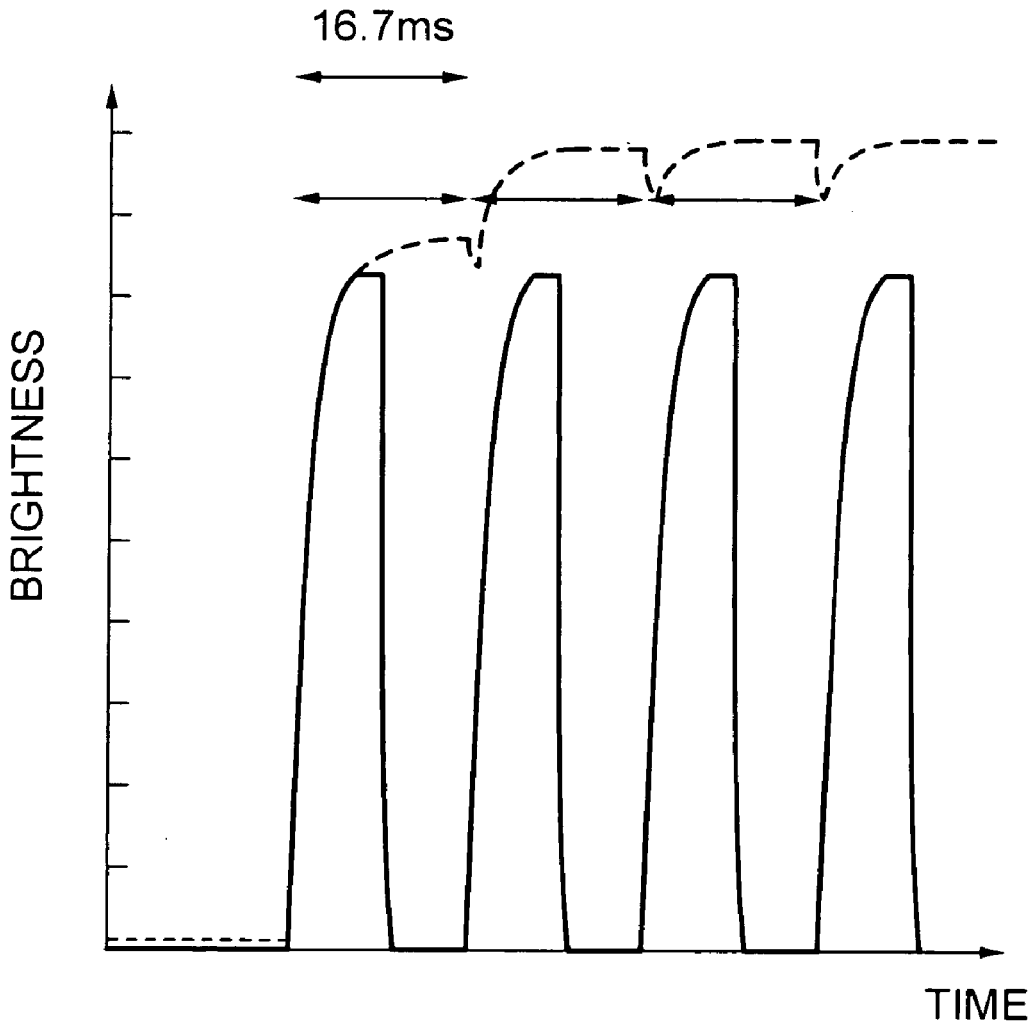
FIG. 4 PRIOR ART
FIG. 4 is a diagram showing a variation with time of brightness when a method using reset is applied to a conventional OCB mode.

From one point of view, the present embodiment corresponds to a pseudo DC driving method utilizing an increased frequency, and from another point of view, it corresponds to a method for driving in which writing operation is performed a plurality of times within each field by AC drive. Specifically, the voltage applied to a data line shown in FIG. 24(*a*) has a rectangular waveform, whose period corresponds to one frame composed of two fields each having a length of 16.7 ms, as in the AC drive of FIG. 2. Meanwhile, the voltage applied to the gate line of FIG. 24(*b*) includes a plurality of (four in FIG. 24(*b*)) on-pulses during each field.

As a result, as shown in FIG. 24(*c*), the transmittance increases gradually within one field (16.7 ms) with the progress of writing operations, and reaches a stable state during the fourth writing operation.

Figure 25:
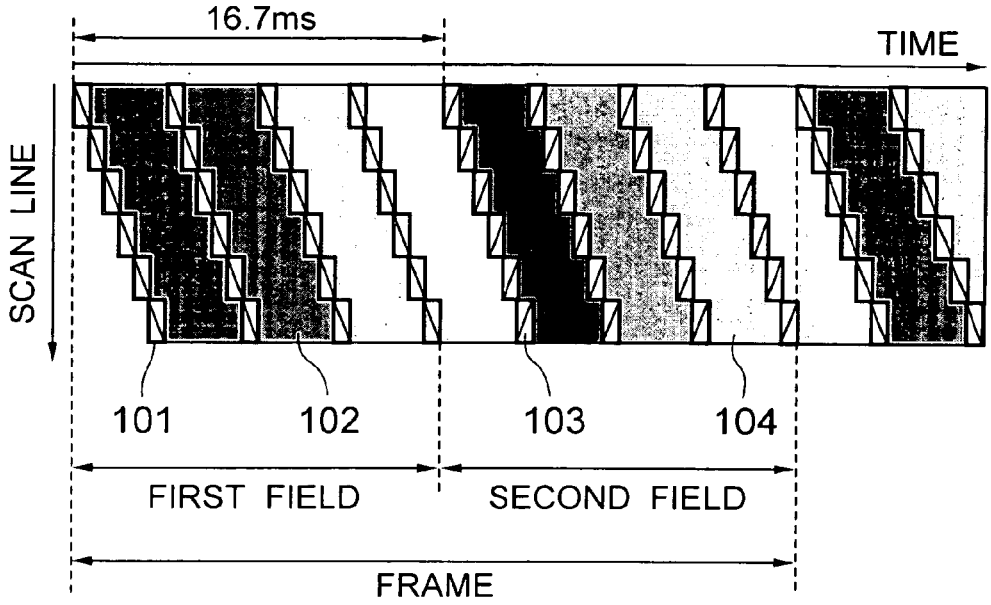
FIG. 25 is a chart showing a time chart for each scan line and display brightness for each scan line.

FIG. 25 is a chart showing a timing chart and display brightness for scan lines according to the first method for driving. FIG. 25 shows the case where six scan lines are provided. The display brightness is shown by way of color shade.

As shown in FIG. 25, while the scan lines are successively scanned from the top, operation of writing a positive data signal is repeated four times to form a first field, and then while the scan lines are successively scanned from the top, operation of writing a negative data signal is repeated four times to complete a second field.

The first field and second field constitute one frame. The length of the first field is 16.7 ms. As is apparent from FIG. 24(*c*), which shows the transmittance, the brightness increases with the number of writing operations within the same field. When the writing operation is performed n times within one field, the writing time for each scan line becomes 1/n the writing time of an ordinary method for driving.

Fifteenth Embodiment

Figure 26:
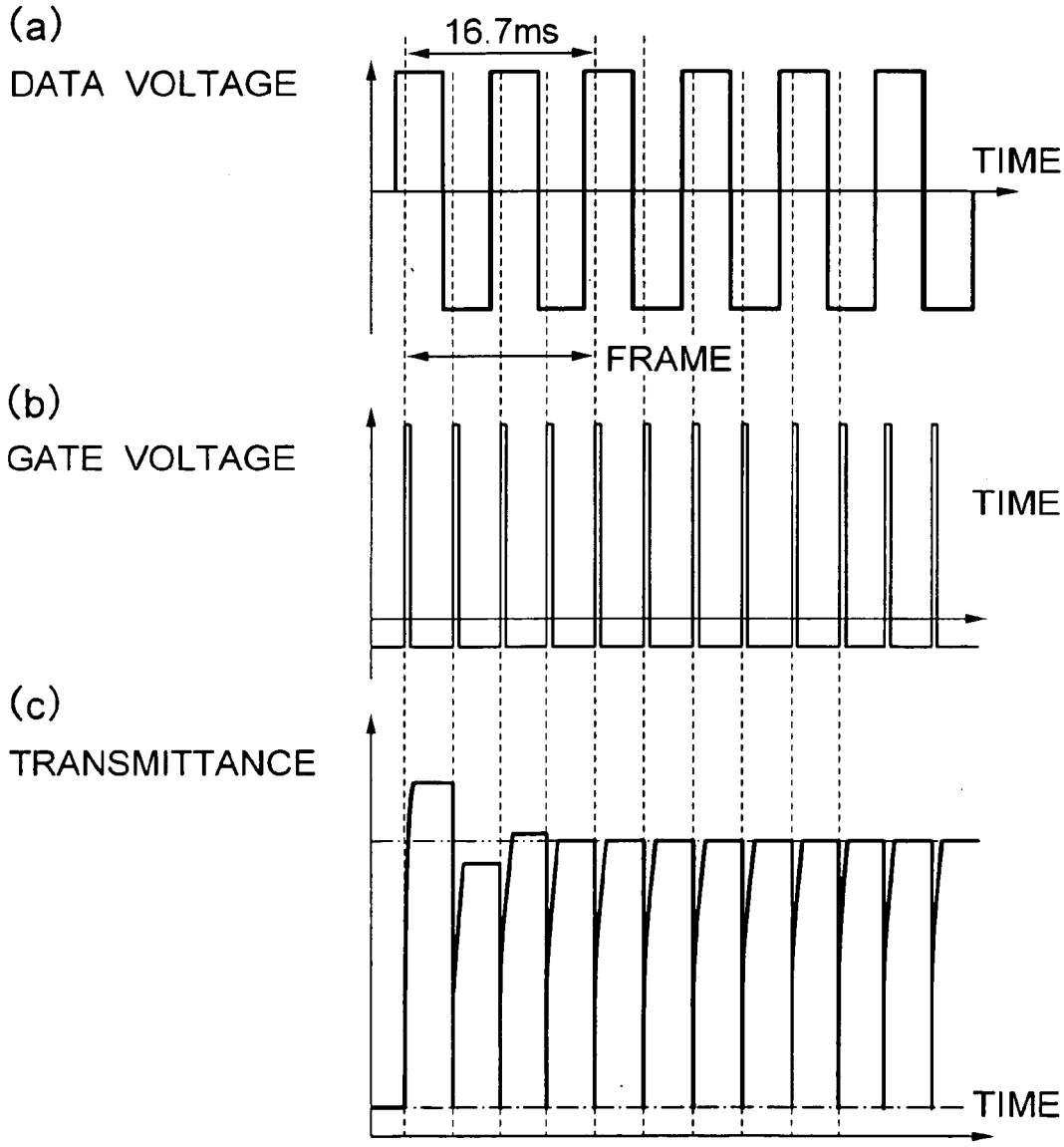
FIG. 26 is waveform charts for describing the structure and operation of a fifteenth embodiment, wherein FIG. 26(*a*) is the waveform of a voltage applied to a data line, FIG. 26(*b*) shows the waveform of a voltage applied to a gate line, and FIG. 26(*c*) shows variation in transmittance when the voltages of FIGS. 26(*a*) and 26(*b*) are applied to fast response liquid crystal.

The present embodiment is another example of a second method for driving a liquid crystal display element according to the present invention. FIG. 26(*a*) shows the waveform of a voltage applied to a data line, FIG. 26(*b*) shows the waveform of a voltage applied to a gate line, and FIG. 26(*c*) shows variation in transmittance when the voltages of FIGS. 26(*a*) and 26(*b*) are applied to fast response liquid crystal.

The present embodiment corresponds to an AC drive method utilizing an increased frequency. Specifically, the voltage applied to a data line shown in FIG. 26(*a*) has a rectangular waveform whose frequency is a few times (two times in FIG. 26(*a*)) that in FIG. 2. Meanwhile, the voltage applied to the gate line show in FIG. 26(*b*) includes a single on-pulse during each field. Each field corresponds to each of positive and negative portions of the voltage waveform of FIG. 26(*a*). As a result, as shown in FIG. 26, four fields are present within each frame.

In the present embodiment, as shown in the variation of transmittance of FIG. 26(*c*), a step response is generated in response to a write signal within a period of 16.7 ms, so that the amplitude of vibration is gradually decreased, and a stable state is attained during the fourth writing operation.

Figure 27:
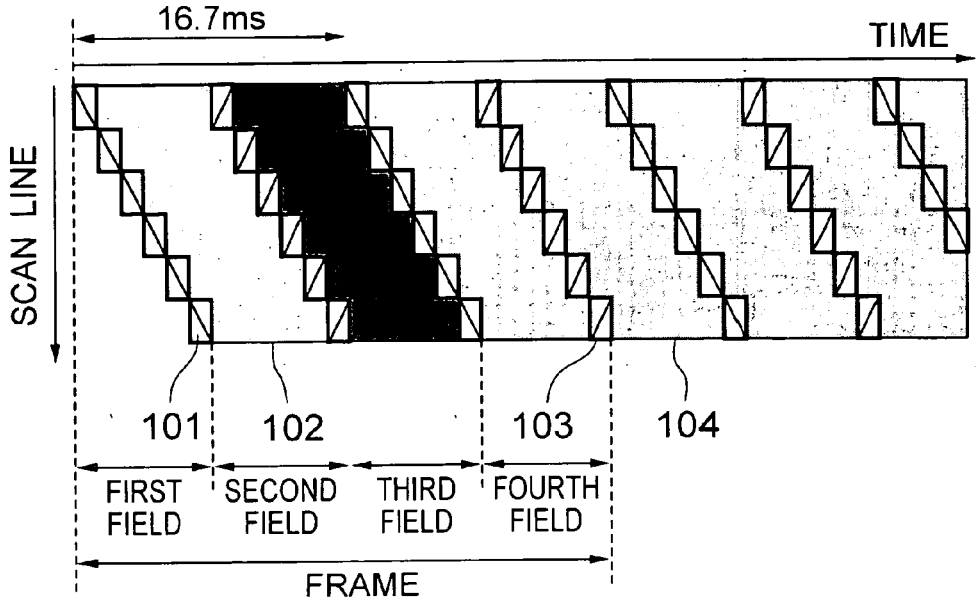
FIG. 27 is a chart showing a time chart for each scan line and display brightness for each scan line.

FIG. 27 is a chart showing a timing chart and display brightness for scan lines. FIG. 27 shows the case where six scan lines are provided. The display brightness is shown by means of color shade. As shown in FIG. 27, while the scan lines are successively scanned from the top, a positive data signal is written to form a first field, and then, while the scan lines are successively scanned from the top after the reverse of the data signal voltage, a negative data signal is written to form a second field. Further, while the scan lines are successively scanned from the top, a positive data signal is written to form a third field, and then, while the scan lines are successively scanned from the top after the reverse of the data signal voltage, a negative data signal is written to form a fourth field.

The first through fourth fields constitute one frame. The length of the first field is 8.35 ms. As is apparent from the graph of FIG. 26(*c*) showing the transmittance, the brightness is changed in an oscillating manner within the frame and becomes stable at the end of the frame. When AC drive is effected n times within one field, the write time for each scan line becomes 1/n the writing time of an ordinary AC drive method.

Sixteenth Embodiment

Figure 28:
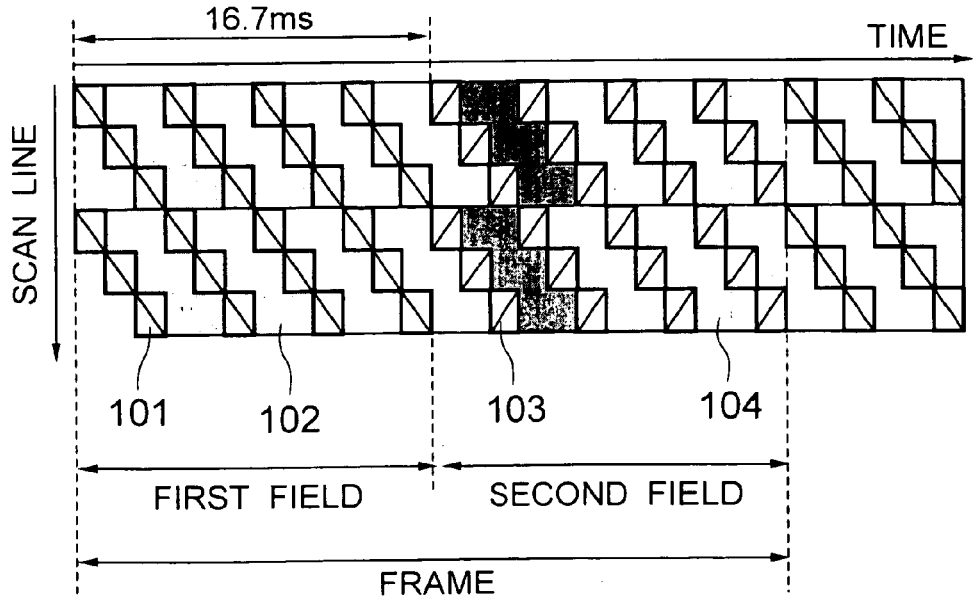
FIG. 28 is a chart showing a time chart for each scan line and display brightness for each scan line in a sixteenth embodiment.

The present embodiment is an example of a third method for driving a liquid crystal display element according to the present invention. FIG. 28 is a chart showing a timing chart and display brightness for scan lines.

As in the fourteenth embodiment, the same data signal is written a plurality of times within one field in the present invention. The present embodiment differs from the fourteenth embodiment in terms of the scanning method. In the present embodiment, a plurality of scan lines are simultaneously selected during scanning. As shown in FIG. 28, a group of scan lines are divided into upper and lower blocks, and scanning is performed such that, in each of the upper and lower blocks, lines are successively selected from top to bottom.

As a result, for each scan line, a period twice that in the fourteenth embodiment can be secured for writing operation. When AC drive is effected n times within one field and the scan lines are divided into m blocks, the write time for each scan line becomes m/n the writing time of an ordinary AC drive method.

Seventeenth Embodiment

Figure 29:
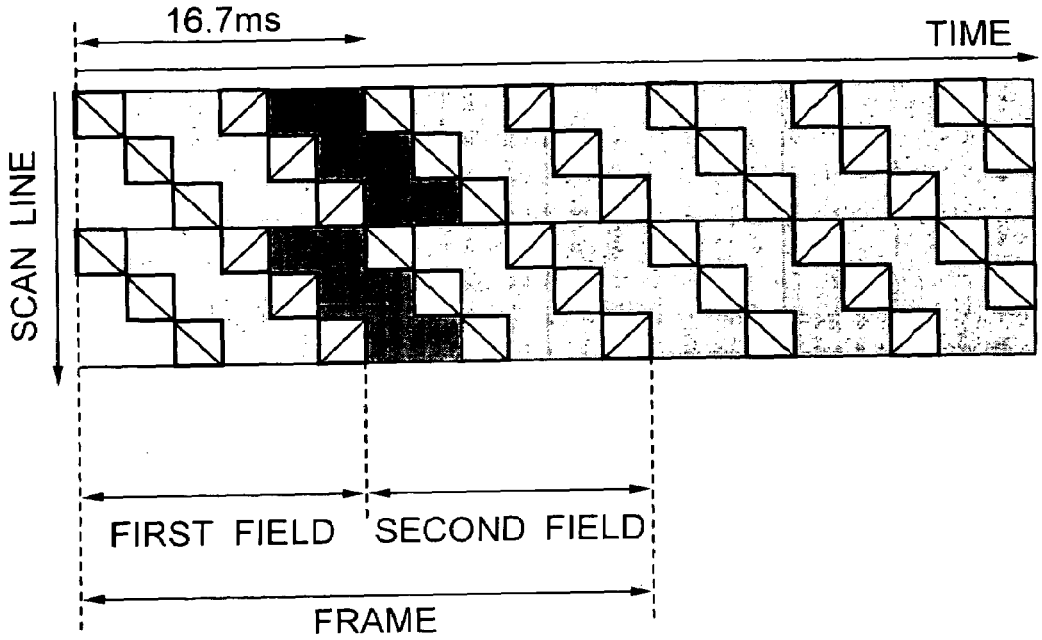
FIG. 29 is a chart showing a time chart for each scan line and display brightness for each scan line in a seventeenth embodiment.

The present embodiment is an example of a fourth method for driving a liquid crystal display element according to the present invention. FIG. 29 is a chart showing a timing chart and display brightness for scan lines.

As in the fifteenth embodiment, AC drive is effected a plurality of times within one frame in the present embodiment. The present embodiment differs from the fifteenth embodiment in terms of the scanning method. In the present embodiment, during scanning a plurality of scan lines are selected simultaneously. As shown in FIG. 29, a group of scan lines are divided into upper and lower blocks, and scanning is performed such that, in each of the upper and lower blocks, lines are successively selected from top to bottom.

As a result, for each scan line, a period twice that in the fifteenth embodiment can be secured for writing operation. When AC drive is effected n times within one field and the scan lines are divided into m blocks, the write time for each scan line becomes m/n the writing time of an ordinary AC drive method.

Eighteenth Embodiment

Figure 30:
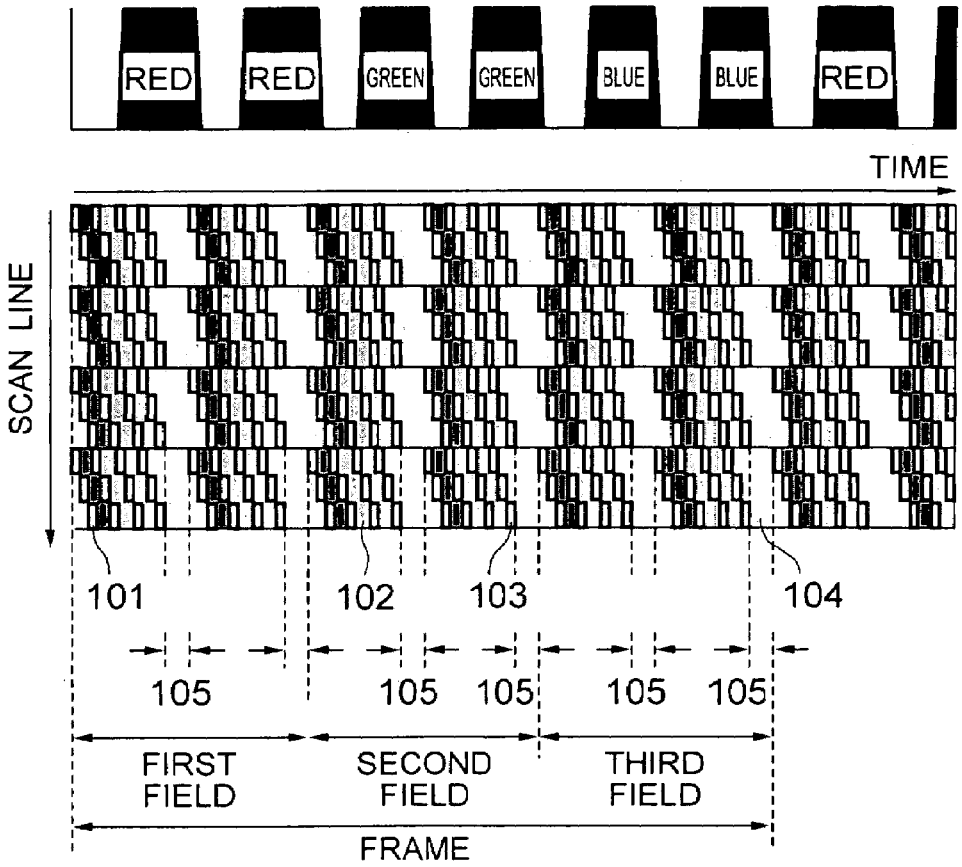
FIG. 30 shows light-source brightness and a time chart for each scan line in an eighteenth embodiment.

The present embodiment is an example of a fifth method for driving a liquid crystal display element according to the present invention. FIG. 30 is a chart showing a timing chart and display brightness for scan lines, thereby showing a time allotment for light source brightness and a time allotment for each scan line.

As in the fourteenth embodiment, the same data signal is written a plurality of times within one field in the present embodiment. Further, scanning is performed in the same manner as in the sixteenth embodiment. The present embodiment differs from the fourteenth and sixteenth embodiments in that the present embodiment employs field sequential drive. Also, a constant display period 105 is provided in each field. FIG. 30 shows an exemplary case where twelve scan lines are provided.

Each frame is divided into three fields corresponding to colors, and AC drive is effected within each field. Further, writing operation is performed a plurality of times within each of positive and negative periods of the AC drive.

Meanwhile, the scan lines are divided into a plurality of blocks, and during scanning a plurality of scan lines are simultaneously selected. As shown in FIG. 30, the scan lines are divided into four blocks, and scanning is performed such that, in each of the blocks, the uppermost scan lines are selected and written simultaneously and the lines are successively selected from top to bottom. This scanning is repeated four times in order to continuously write a signal of a single polarity (positive in this case). Subsequently, a display period 105 is provided. The polarity of the data signal is reversed, and an operation for simultaneously scanning the four blocks is repeated four times, such that a negative writing 103 ends, after which a display period 105 is provided.

At this time, the light source is maintained in an on state during a period including the display period, and is maintained in an off state during a period in which the transmittance is unstable. Through this procedure, the first field is formed to complete display of red. Fields for green and blue are displayed in a similar manner. The three fields form a single frame.

Nineteenth Embodiment

Figure 31:
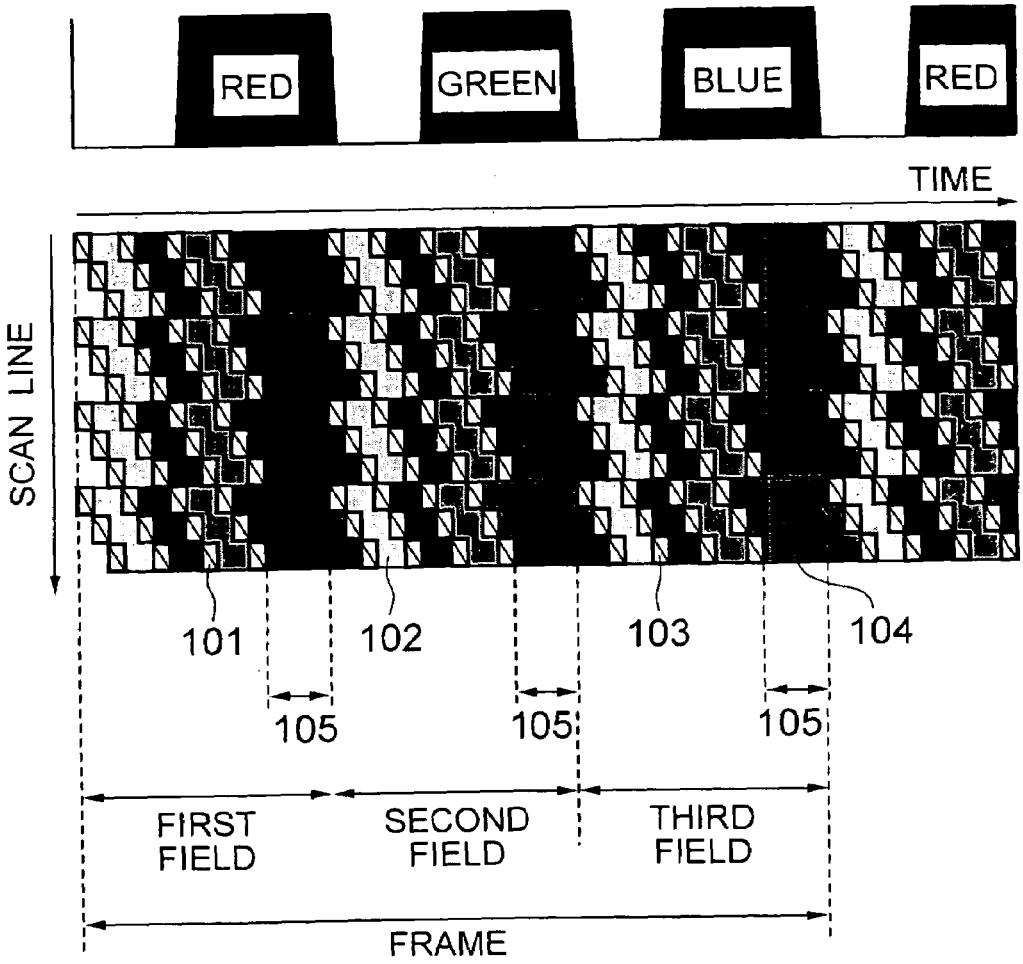
FIG. 31 shows light-source brightness and a time chart for each scan line in a nineteenth embodiment.

The present embodiment is an example of a sixth method for driving a liquid crystal display element according to the present invention. FIG. 31 is a chart showing a timing chart and display brightness for scan lines, thereby showing a time allotment for light source brightness, and a time allotment for each scan line.

As in the fifteenth embodiment, AC drive is effected a plurality of times within one field in the present embodiment. Further, scanning is performed in the same manner as in the seventeenth embodiment. The present embodiment differs from the fifteenth and seventeenth embodiments in that the present embodiment employs field sequential drive. Also, a constant display period 105 is provided in each field.

FIG. 31 shows an exemplary case where twelve scan lines are provided. Each frame is divided into three fields corresponding to three colors, and AC drive is effected within each field. Further, AC drive is performed a plurality of times.

Meanwhile, the scan lines are also divided into a plurality of blocks, and a plurality of scan lines are simultaneously selected during scanning. As shown in FIG. 31, the scan lines are divided into four blocks, and scanning is performed such that each of the blocks are successively selected from top to bottom. This scanning is repeated four times in order to perform AC drive for two periods. Subsequently, a display period 105 is provided.

At this time, the light source is maintained in an on state during a period including the display period, and is maintained in an off state during a period in which the transmittance is unstable. Through this procedure, the first field is formed to complete display of red. Fields for green and blue are displayed in a similar manner. The three fields form a single frame.

Twentieth Embodiment

Figure 32:
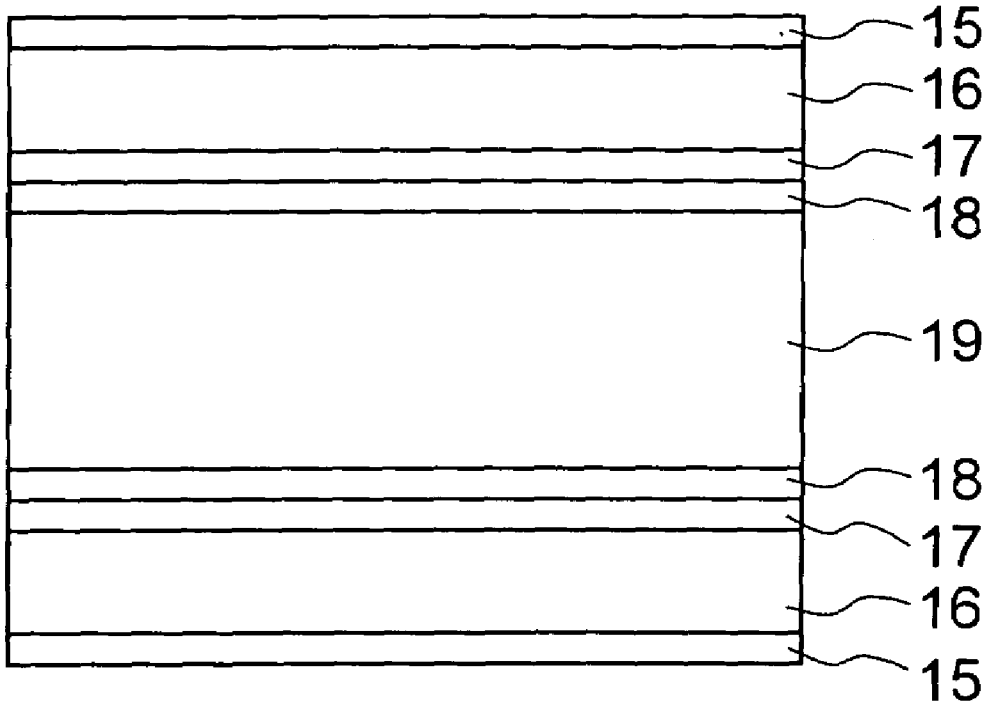
FIG. 32 is a cross-sectional view showing a layered structure of a liquid crystal display apparatus according to a twentieth embodiment.

The present embodiment is an example of a liquid crystal display apparatus of the present invention, which employs any one of the drive methods according to the fourteenth through seventeenth embodiments. FIG. 32 is a schematic view showing an example of the structure of a liquid crystal display apparatus to which the drive method of the present invention is applied, and is substantially identical with that of FIG. 23.

In the liquid crystal display apparatus of the present embodiment, an electrode 17 is formed on each of two support substrates 16, and an orientation film 18 for orienting liquid crystal is formed thereon. Liquid crystal 19 is held between the support substrates 16, and a pair of polarization plates are provided on the outer surfaces of the support substrates 16. Thus, a liquid crystal display apparatus is constituted.

Next, the operation of the present embodiment will be described. A data signal having a waveform corresponding to a selected drive method is applied, corresponding to each of gate lines, to each drain bus line at a predetermined frequency. Further, a signal having a waveform shown in the respective embodiment and capable of turning on an active element is applied to each gate bus line when the gate bus line is selected. Thus, the voltage on the drain bus line is applied to the liquid crystal via the display electrode. The applied voltage is held in the liquid crystal until the gate bus line is selected again. This enables the operation of holding a display if the liquid crystal does not have an ability of storing. For reset operation, a predetermined reset signal is applied to the drain line, and a voltage for turning on the active element is applied at the timing shown in the respective embodiment.

Employment of the above structure enables realization of a liquid crystal display apparatus to which the drive method according to any one of the first through fourth embodiments of the present invention is applied.

Twenty-First Embodiment

The present embodiment is an example of a liquid crystal display apparatus of the present invention, which employs any one of the drive methods according to the eighteenth and nineteenth embodiments.

In the liquid crystal display apparatus of the present embodiment, an electrode is formed on each of two support substrates, and an orientation film for orienting liquid crystal is formed thereon. Liquid crystal is held between the support substrates, and a pair of polarization plates are provided on the outer surfaces of the support substrates. Further, a light source for field sequential display is provided in the vicinity of one polarization plate.

This constitution realizes a liquid crystal display apparatus to which the drive method of the eighteenth or nineteenth embodiment is applied.

Next, the second and third inventions will be described in detail with reference to examples. However, the present invention is not limited to the following examples.

Example 6

The present example is an example of the liquid crystal display apparatus according to the present invention. In the present example, chromium (Cr) lines each having a width of 10 μm were formed by sputtering to provide 480 gate bus lines and 640 drain bus lines. A gate insulating film was formed by use of silicon nitride ($SiN_x$).

Each pixel had a length of 330 μm and a width of 110 μm. TFTs (thin-film transistors) were formed from amorphous silicon, and transparent electrodes serving as pixel electrodes of indium tin oxide (ITO) were formed through sputtering. The glass substrate on which TFTs had been formed in an array was used as a first substrate.

A second substrate to be disposed opposite to the first substrate was formed as follows. A light-shielding film of chromium was formed on a glass plate, and transparent electrodes (common electrodes) of ITO were formed thereon. Subsequently, a color filter was formed in a matrix shape by use of a staining technique, and a protective layer of silica was formed thereon. Subsequently, soluble polyimide was printed, and the substrate was baked at 180° C. in order to remove the solvent. Subsequently, polyamic acid was applied thereon by a spin coat method, and the substrates were baked at 200° C. in order to form polyimide film through imidation.

Through use of a rubbing apparatus in which Nylon buffing cloth is wound around a roller having a diameter of 50 mm, the polyimide film was rubbed such that cross rubbing was performed twice under the following conditions: roller rotational speed of 600 rpm, stage feed speed of 40 mm/sec, pressing amount of 0.7 mm, and rubbing cross angle of 10°.

The thickness of the orientation film was about 500 angstroms, as measured through use of a contact-type step meter, and the pre-tilt angle was 1.5 degrees, as measured by a crystal rotation method.

Micro pearls having a diameter of about 2 μm and serving as spherical spacers were dispersed on one of the glass substrates, and a thermosetting seal material in which cylindrical rod spacers made of glass and having a diameter of about 2 μm had been dispersed was applied to the other glass plate. These plates were disposed such that they faced each other and their directions of rubbing intersected at an angle of 10°. Subsequently, the seal material was hardened through heat treatment, thereby completing a panel having a gap of 2 μm.

Antiferroelectric liquid crystal composition performing V-shaped switching disclosed in Asia Display 95, pp 61–64 was injected in an isotropic phase (Iso) state into the panel at 85° C. under vacuum.

The value of spontaneous polarization of this liquid crystal was 165 $nC/cm^2$, as measured through application of a triangular waveform. Although the response speed varied depending on a gradation voltage, it was 200 to 800 μsec. While the temperature was maintained at 85° C., a rectangular wave having an amplitude of ±10 V and a frequency of 3 kHz was applied to the entire surface of the panel through use of an arbitrary waveform generator and a high output amplifier. In this state, the liquid crystal panel was gradually cooled to room temperature at a rate of 0.1° C./min. while an electric field was applied.

A driver IC was attached to the thus-fabricated liquid crystal panel in order to complete the liquid crystal display apparatus.

The drive method of the first embodiment was applied to the above-described liquid crystal display apparatus. Specifically, the length of each field was set to 16.7 msec, the length of each frame period was set to 33.4 msec, the length of the write period for each scan line was set to 4.2 μsec, and writing operation was performed eight times during each field.

Figure 33:
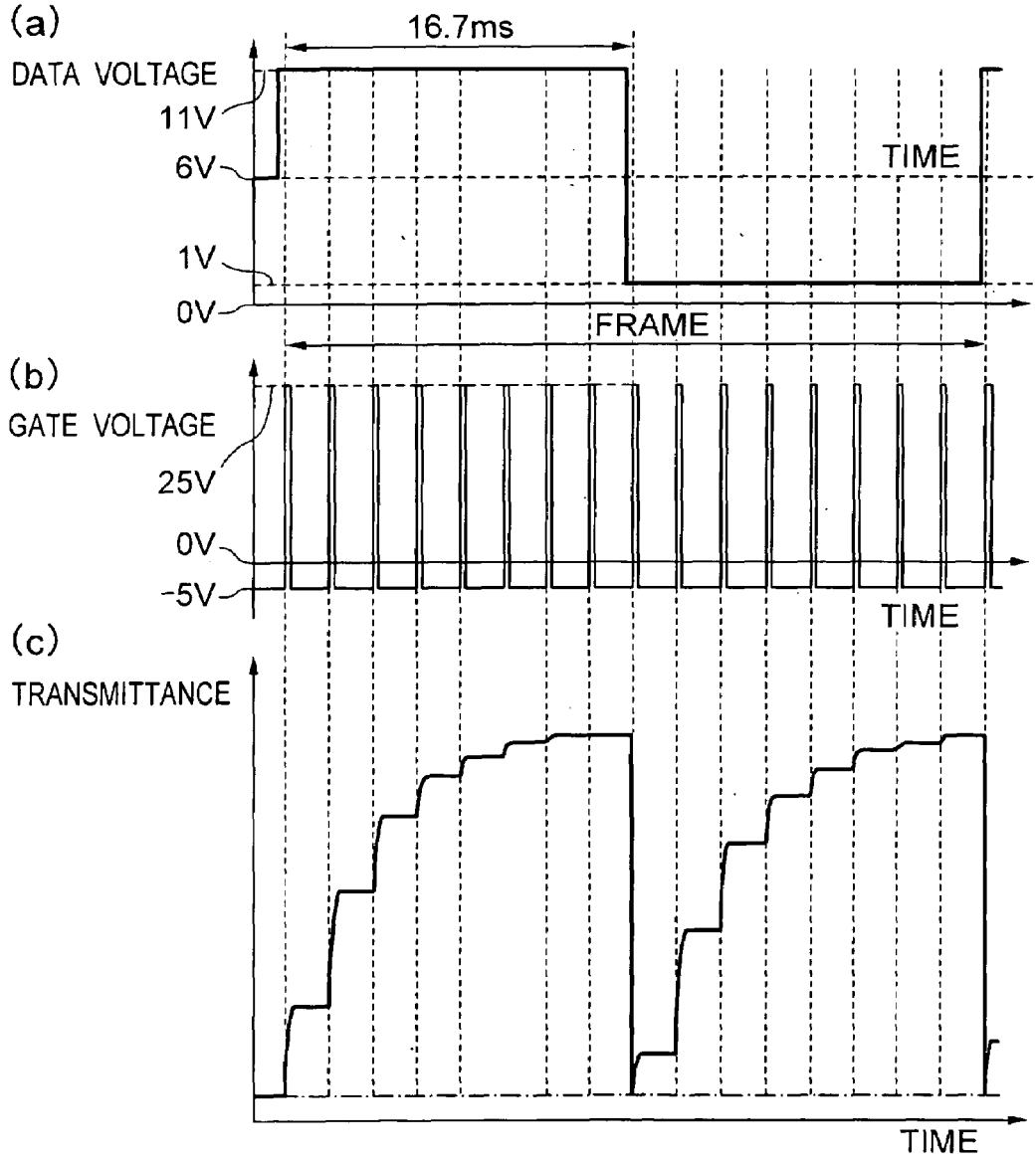
FIG. 33 is charts for describing the operation of a liquid crystal display apparatus according to Example 6, wherein FIG. 33(*a*) is the waveform of a voltage applied to a data line, FIG. 33(*b*) shows the waveform of a voltage applied to a gate line, and FIG. 33(*c*) shows variation in transmittance when the voltages of FIGS. 33(*a*) and 33(*b*) are applied.

FIG. 33 shows the waveform of an applied voltage and a change in transmittance measured for one pixel. FIG. 33(*a*) is a voltage applied to a drain, FIG. 33(*b*) is a voltage applied to a gate, and FIG. 33(*c*) shows variation in transmittance.

In the present example, since the degree of spontaneous polarization of liquid crystal was large, the variation of the holding ratio caused by the response of crystal after writing operation was large. Consequently, the number of writing operations required for obtaining a stable transmission coefficient increased to 8, which is greater than that in the fourteenth embodiment.

The present method enables realization of a liquid crystal display apparatus of a high-speed response in which response for obtaining all intermediate gradations ends within one field even when a reset pulse method is not used and no frame memory is provided.

Example 7

The present example is another example of the liquid crystal display apparatus according to the present invention.

In the present example, a TFT substrate and a CF (color filter) substrate were fabricated in the same manner as in Example 6, and a panel was assembled in the same manner as in Example 6. Liquid crystal composition disclosed in Japanese Patent Application No. 97-093853 was injected in an isotropic phase (Iso) state into the panel at 85° C. under vacuum. The composition of the liquid crystal was adjusted such that the value of spontaneous polarization of the liquid crystal composition became about 20 nC/cm$^2$. The value of spontaneous polarization of this liquid crystal actually was 19.5 nC/cm$^2$, as measured through application of a triangular waveform. Although the response speed varied depending on a gradation voltage, it was between 600 μsec and 2 msec. After injection, the panel was cooled to room temperature at a rate of 0.1° C./min.

A driver IC was attached to the thus-fabricated liquid crystal panel in order to complete the liquid crystal display apparatus.

Figure 34:
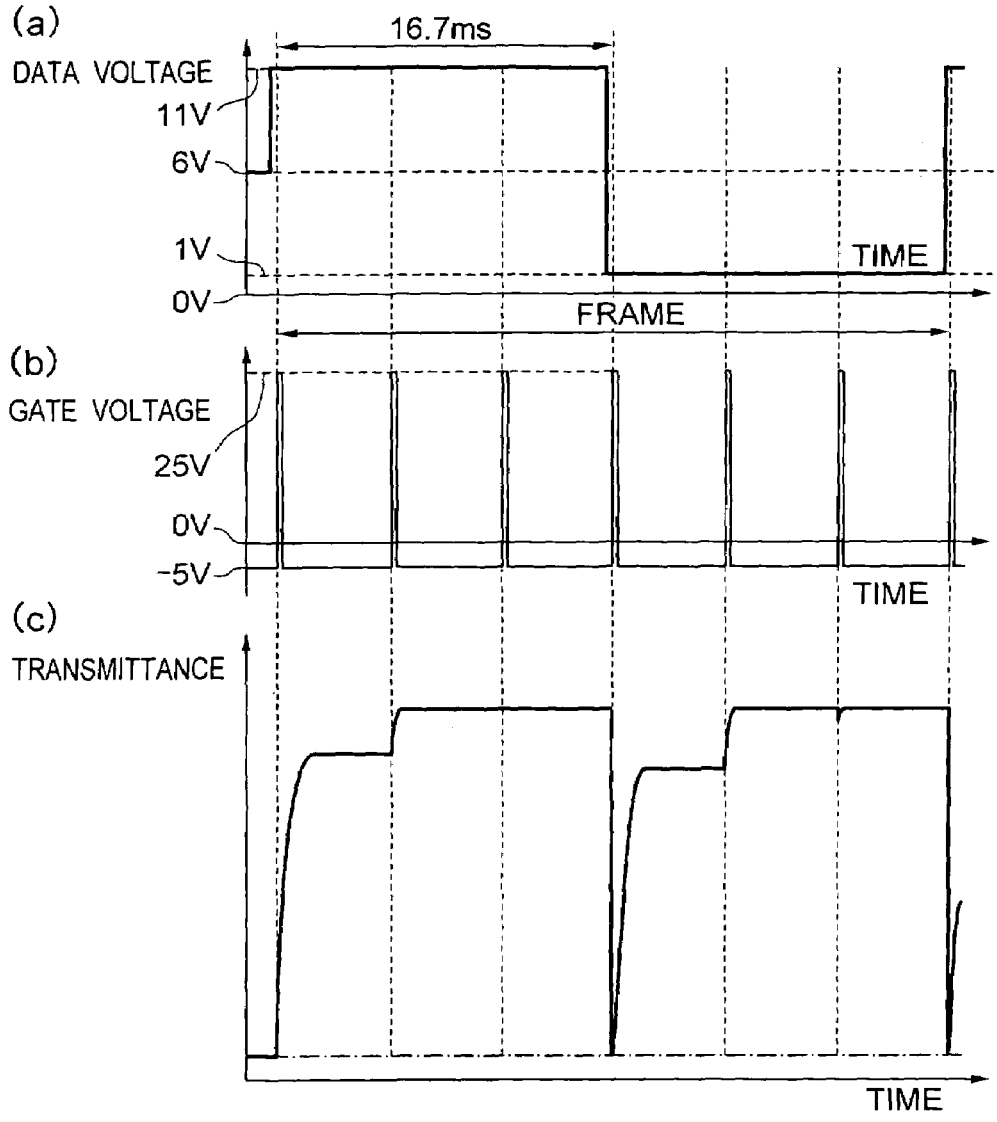
FIG. 34 is charts for describing the operation of a liquid crystal display apparatus according to Example 7, wherein FIG. 34(*a*) is the waveform of a voltage applied to a data line, FIG. 34(*b*) shows the waveform of a voltage applied to a gate line, and FIG. 34(*c*) shows variation in transmittance when the voltages of FIGS. 34(*a*) and 34(*b*) are applied to liquid crystal.

The liquid crystal display apparatus was driven by the drive method of the fourteenth embodiment. Specifically, the length of each field was set to 16.7 msec, the length of each frame period was set to 33.4 msec, the length of the write period for each scan line was set to 11.5 μsec, and writing operation was performed three times during each field. FIG. 34 shows the waveform of an applied voltage and a change in transmittance measured for one pixel. FIG. 34(*a*) shows a voltage applied to a drain, FIG. 34(*b*) shows a voltage applied to a gate, and FIG. 34(*c*) shows variation in transmittance.

In the present example, since the degree of spontaneous polarization of liquid crystal was small, the variation of the holding ratio caused by the response of crystal after writing operation was small. Consequently, the number of writing operations required for obtaining a stable transmission coefficient decreased to 3, which was smaller than that in the fourteenth embodiment. When the number of required writing operations decreases, decrease of the writing period can be suppressed as compared with the case of Example 6. At the same time, the increase of the frequency of the drive circuit is suppressed, so that the cost of the drive circuit is lowered.

It is to be noted that even though the response speed of the liquid crystal itself was lower than that in Example 6, the time required to reach a stable state was shorter than that in Example 6 when the drive method of the present example was used. As in Example 6, the present method enables realization of a liquid crystal display apparatus of high-speed response in which response for obtaining all intermediate gradations ends within one field even when a reset pulse method is not used and no frame memory is provided.

Example 8

The present example is a further example of the liquid crystal display apparatus according to the present invention. In the present example, a TFT substrate was fabricated in the same manner as in Example 6. A second substrate to be disposed opposite to the first substrate was formed as follows. A light-shielding film of chromium was formed on a glass plate, a color filter was formed by an ink-jet scheme in which bubbles of dye were jetted, and an ITO film was formed thereon, on which a protective layer of silica was formed.

Through use of a rubbing apparatus in which rayon buffer cloth is wound around a roller having a diameter of 50 mm, the polyimide film was rubbed such that parallel rubbing was performed two times under the following conditions: roller rotational speed of 600 rpm, stage feed speed of 40 mm/sec, and pressing amount of 0.7 mm.

The thickness of the orientation film was about 500 angstroms, as measured through use of a contact-type step meter, and the pre-tilt angle was 7 degrees, as measured by a crystal rotation method. Micro pearls having a diameter of about 9.5 μm and serving as spherical spacers were dispersed on one of the glass substrates, and an ultraviolet hardening-type seal material in which cylindrical rod spacers made of glass and having a diameter of about 9.5 μm had been dispersed was applied to the other glass plate.

These plates were disposed such that they faced each other and their directions of rubbing became parallel to each other. Subsequently, ultraviolet rays were radiated in a non-contacting manner in order to cure the seal material, thereby completing a panel having a gap of 9.5 μm.

Nematic liquid crystal was injected into this panel. In the present embodiment, a compensation plate was added in order to operate the panel in an OCB (optically compensated bi-refligence) display mode described in SID 94, digest, pp. 927–930.

A driver was attached to the thus-fabricated liquid crystal panel in order to complete the liquid crystal display apparatus. Although the response speed varied depending on a gradation voltage, it was 1.5 to 4 msec.

The drive method of the fourteenth embodiment was applied to the above-described liquid crystal display apparatus. Specifically, the length of each field was set to 16.7 msec, the length of each frame period was set to 33.4 msec, the length of the write period for each scan line was set to 11.5 μsec, and writing operation was performed three times during each field. The applied waveform was similar to that of FIG. 34. Since the response speed of the liquid crystal itself is lower than that in Example 7, the response in relation to transmission coefficient is also slightly low.

However, since the number of writing operations required to reach a stable state was low, the time required to reach the stable state was shorter as compared with the liquid crystal display apparatus of Example 6, whose response speed was about five times faster. As in Examples 6 and 7, the present method enables realization of a liquid crystal display apparatus of high-speed response in which response for obtaining all intermediate gradations ends within one field even when a reset pulse method is not used and no frame memory is provided.

Example 9

The present example is yet another example of the liquid crystal display apparatus according to the present invention. In the present example, a liquid crystal panel was fabricated in the same manner as in Example 7, and a driver was attached to the panel in order to obtain a liquid crystal display apparatus. The liquid crystal display apparatus was driven by the drive method of the fifteenth embodiment.

In the present example, the writing time for each writing operation could be made longer than that in Example 7.

Example 10

The present example is still another example of the liquid crystal display apparatus according to the present invention. In the present example, a liquid crystal panel was fabricated in the same manner as in Example 7, and a driver was attached to the panel so as to obtain a liquid crystal display apparatus. The liquid crystal display apparatus was driven by the drive method of the seventeenth embodiment.

In the present example, the writing time for each writing operation could be made longer than that in Example 9, so that no difference was observed between the present example and an ordinary AC drive.

As a result, an inexpensive, high performance liquid crystal display apparatus was realized without use of elements for high frequency operation.

Example 11

The present example is still another example of the liquid crystal display apparatus according to the present invention. A liquid crystal panel used in the present example has the same structure as that of the liquid crystal panel used in Example 7. A driver and a backlight that was switchable at high speed were attached to the panel to obtain a field-sequential liquid crystal display apparatus.

The drive of the liquid crystal display apparatus and the scanning of brightness of a light source were performed in the same manner as in the eighteenth embodiment. Specifically, writing operation for each polarity was performed four times, and the scan lines were divided into two blocks. The display period 105 was set to 2 msec, the length of the write period for each scan line was set to 3.5 μsec, and the length of each frame period was set to 33.3 msec. At that time, within each frame, two on-periods of 2.5 msec; i.e., a total on period of 5 msec, could be secured for each color in order to turn on the light source.

Example 12

The present example is a still further example of the liquid crystal display apparatus according to the present invention. A liquid crystal panel used in the present example has the same structure as that of the liquid crystal panel used in Example 7. A driver and a back light that was switchable at high speed were attached to the panel to obtain a field-sequential liquid crystal display apparatus.

The drive and the liquid crystal display apparatus and the scanning of brightness of the light source were performed in the same manner as in the nineteenth embodiment. Specifically, AC drive was effected twice within each frame, and the scan lines were divided into two blocks. The display period 105 was set to 7.7 msec, the length of the write period for each scan line was set to 3.5 μsec, and the length of each frame period was set to 33. 3 msec. At that time, within each frame, two on-periods of 2.5 msec; i.e., a total on-period of 8 msec could be secured for each color in order to turn on the light source, which was longer than in Example 6.

Example 13

The present invention is a yet further example of the liquid crystal display apparatus according to the present invention. In the present example, a micro display was fabricated as a reflection type projector. The micro display had a similar structure as that of a micro display produced by Displaytech Corp. described at the beginning of Advanced Imaging, January, 1997.

Specifically, MOS FETs were formed on a silicon wafer in accordance with a 0.8 μm rule in order to fabricate a DRAM. The die size was ½ inch, the pixel pitch was 10 μm, and the capacity of the DRAM was 1M bits. The aperture ratio of the pixel was 90% or higher. Further, the surface of the fabricated DRAM was made flat by use of a chemical mechanical polishing technique. A cover glass for microscope observation was used as the opposite substrate.

A portion including a drive circuit was cut from a silicon wafer, and orientation film formed of soluble polyimide was printed. Subsequently, the substrate was baked at 170° C. in order to remove the solvent. Through use of a rubbing apparatus in which Nylon buff cloth is wound around a roller having a diameter of 50 mm, the polyimide film was rubbed twice under the following conditions: roller rotational speed of 6000 rpm, stage feed speed of 40 mm/sec, and press amount of 0.7 mm.

The thickness of the orientation film measured through use of a contact-type step meter was about 500 angstroms, and the pre-tilt angle measured by a crystal rotation method was 1.5 degrees.

A light-curing-type seal material in which cylindrical rod spacers made of glass and having a diameter of about 2 μm had been dispersed was applied. These substrates were disposed such that they faced each other, and ultraviolet rays were radiated in a non-contacting manner in order to cure the seal material, thereby completing a panel having a gap of 2 μm. Subsequently, antiferroelectric liquid crystal composition performing V-shaped switching disclosed in Asia Display 95, pp 61–64 was injected in an isotropic phase (Iso) state into the panel at 85° C. under vacuum.

While the temperature was maintained at 85° C., a rectangular wave having an amplitude of ±10 V and a frequency of 3 kHz was applied to the entire surface of the panel through use of an arbitrary waveform generator and a high output amplifier. In this state, the liquid crystal panel was gradually cooled to room temperature at a rate of 0.1° C./min. while an electric field was applied. Further, three light emitting diodes of three colors, a collimate lens for obtaining parallel light, a polarization conversion element, and a projection lens were combined to complete a reflection type field sequential projector.

The liquid crystal display apparatus is driven by the drive method of the nineteenth embodiment. As a result, a projector display of high response speed was obtained.

Although preferred embodiments and examples of the present invention have been described above, the liquid crystal drive methods and liquid crystal display apparatus of the invention are not limited thereto, and those obtained by changing or modifying the structures of the embodiments and examples are also encompassed by the scope of the present invention.

What is claimed is:

1. A method for driving an active-matrix liquid crystal display apparatus without ability of storing, the method comprising the steps of:

scanning successively a plurality of scan lines in a first field of a frame for display;

simultaneously resetting a voltage difference between pixel electrodes and common electrodes in the first field after the scan lines are successively scanned in the first field;

scanning successively the scan lines in a second field of the frame for display in an order reverse to that in the first field; and simultaneously resetting a voltage difference between pixel electrodes and common electrodes in the second field after the scan lines are successively scanned in the second field.

2. The method for driving the active-matrix liquid crystal display apparatus as defined in claim 1, wherein the first and second fields constitute one frame in interlace drive.

3. The method for driving the active-matrix liquid crystal display apparatus as defined in claim 2 wherein two write periods are provided for each scan line.

4. The method for driving the active-matrix liquid crystal display apparatus as defined in claim 3 wherein two reset periods are provided for each scan line.

5. The method for driving the active-matrix liquid crystal display apparatus as defined in claim 3 wherein in each frame a single reset period is provided for each scan line, and a data signal voltage used in a first writing operation after the reset has an absolute value smaller than that of a data signal voltage used in a second writing operation.

6. A method for driving a field-sequential active-matrix liquid crystal display apparatus wherein data corresponding to three colors are successively displayed, and the drive for each color is performed by the method of claim 5.

7. A method for driving a field-sequential active-matrix liquid crystal display apparatus in which data corresponding to three colors are successively displayed, and the drive for each color is performed by the method of claim 1.

8. An active-matrix liquid crystal display apparatus characterized by comprising liquid crystal driven by the method according to any one of claims 1–5.

9. An active-matrix liquid crystal display apparatus comprising liquid crystal driven by the method according to claim 6 or 7.

10. A method for driving a plurality of scan lines of a liquid crystal display apparatus, the method comprising the steps of:

scanning successively odd-numbered scan lines in a first field of a frame for display;

simultaneously resetting even-numbered scan lines in the first field after the odd-numbered scan lines are successively scanned in the first field;

scanning successively the even-numbered scan lines in a second field of the frame for display in an order reverse to the odd-numbered scan lines successively scanned in the first field; and simultaneously resetting the odd-numbered scan lines in the second field after the even-numbered scan lines are successively scanned in the second field.

11. A method for driving a plurality of scan lines of a liquid crystal display apparatus, the method comprising the steps of:

scanning successively odd-numbered scan lines in a first field of a frame for display;

simultaneously resetting even-numbered scan lines in the first field after the odd-numbered scan lines are successively scanned in the first field;

scanning successively the even-numbered scan lines in the first field of the frame for display in an order reverse to the odd-numbered scan lines successively scanned in the first field;

simultaneously resetting the odd-numbered scan lines in the first field after the even-numbered scan lines are successively scanned in the first field;

scanning successively the odd-numbered scan lines in a second field of the frame for display;

simultaneously resetting the even-numbered scan lines in the second field after the odd-numbered scan lines are successively scanned in the second field;

scanning successively the even-numbered scan lines in the second field of the frame for display in an order reverse to the odd-numbered scan lines successively scanned in the second field;

simultaneously resetting the odd-numbered scan lines in the second field after the even-numbered scan lines are successively scanned in the second field.

12. A method for driving a plurality of scan lines of a liquid crystal display apparatus, the method comprising the steps of:

scanning successively odd-numbered scan lines in a first field of a frame for display;

simultaneously resetting even-numbered scan lines in the first field after the odd-numbered scan lines are successively scanned in the first field;

scanning successively the even-numbered scan lines in the first field of the frame for display;

simultaneously resetting the odd-numbered scan lines in the first field after the even-numbered scan lines are successively scanned in the first field;

scanning successively the odd-numbered scan lines in a second field of the frame for display in an order reverse to an order of scanning of the odd-numbered scan lines in the first field;

simultaneously resetting the even-numbered scan lines in the second field after the odd-numbered scan lines are successively scanned in the second field;

scanning successively the even-numbered scan lines in the second field of the frame for display in an order reverse to an order of scanning of the even-numbered scan lines in the first field;

simultaneously resetting the odd-numbered scan lines in the second field after the even-numbered scan lines are successively scanned in the second field.

13. A method for driving a plurality of scan lines of a liquid crystal display apparatus, the method comprising the steps of:

scanning successively odd-numbered scan lines in a first field of a frame for display;

simultaneously resetting even-numbered scan lines in the first field after the odd-numbered scan lines are successively scanned in the first field;

scanning successively the even-numbered scan lines in the first field of the frame for display in an order reverse to the odd-numbered scan lines successively scanned in the first field;

simultaneously resetting the odd-numbered scan lines in the first field after the even-numbered scan lines are successively scanned in the first field;

scanning successively the odd-numbered scan lines in a second field of the frame for display in an order reverse to the odd-numbered scan lines successively scanned in the first field;

simultaneously resetting the even-numbered scan lines in the second field after the odd-numbered scan lines are successively scanned in the second field;

scanning successively the even-numbered scan lines in the second field of the frame for display in an order reverse to the even-numbered scan lines successively scanned in the first field;

simultaneously resetting the odd-numbered scan lines in the second field after the even-numbered scan lines are successively scanned in the second field.

* * * * *